US009725782B2

(12) United States Patent
Nonaka et al.

(10) Patent No.: US 9,725,782 B2
(45) Date of Patent: Aug. 8, 2017

(54) HOT STAMPED STEEL AND METHOD FOR PRODUCING THE SAME

(71) Applicant: Nippon Steel & Sumitomo Metal Corporation, Tokyo (JP)

(72) Inventors: Toshiki Nonaka, Tokyo (JP); Satoshi Kato, Tokyo (JP); Kaoru Kawasaki, Tokyo (JP); Toshimasa Tomokiyo, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 213 days.

(21) Appl. No.: 14/371,481

(22) PCT Filed: Jan. 11, 2013

(86) PCT No.: PCT/JP2013/050377
§ 371 (c)(1),
(2) Date: Jul. 10, 2014

(87) PCT Pub. No.: WO2013/105631
PCT Pub. Date: Jul. 18, 2013

(65) Prior Publication Data

US 2015/0050519 A1 Feb. 19, 2015

(30) Foreign Application Priority Data

Jan. 13, 2012 (JP) ..... 2012-004552

(51) Int. Cl.
*C22C 38/02* (2006.01)
*C22C 38/04* (2006.01)
(Continued)

(52) U.S. Cl.
CPC ..... *C21D 8/0263* (2013.01); *C21D 8/0226* (2013.01); *C21D 8/0236* (2013.01);
(Continued)

(58) Field of Classification Search
None
See application file for complete search history.

(56) References Cited

U.S. PATENT DOCUMENTS

2007/0023113 A1 2/2007 Ikeda et al.
2011/0240176 A1 10/2011 Kaneko et al.
(Continued)

FOREIGN PATENT DOCUMENTS

CA 2787575 A1 8/2011
CN 101802233 8/2010
(Continued)

OTHER PUBLICATIONS

Machine-English translation of JP 2008-156734, Kawabe Hidenao et al., Jul. 10, 2008.*
(Continued)

*Primary Examiner* — Deborah Yee
(74) *Attorney, Agent, or Firm* — Birch, Stewart, Kolasch & Birch, LLP

(57) ABSTRACT

In a hot stamped steel, when [C] represents an amount of C (mass %), [Si] represents an amount of Si (mass %), and [Mn] represents an amount of Mn (mass %), an expression of 5×[Si]+[Mn])/[C]>10 is satisfied, a metallographic structure includes 80% or more of a martensite in an area fraction, and optionally, further includes one or more of 10% or less of a pearlite in an area fraction, 5% or less of a retained austenite in a volume ratio, 20% or less of a ferrite in an area fraction, and less than 20% of a bainite in an area fraction, TS×λ, which is a product of TS that is a tensile strength and λ that is a hole expansion ratio is 50000 MPa·% or more, and a hardness of the martensite measured with a nanoindenter satisfies H2/H1<1.10 and σHM<20.

13 Claims, 6 Drawing Sheets

(51) Int. Cl.

| | |
|---|---|
| ***C22C 38/06*** | (2006.01) |
| ***C22C 38/12*** | (2006.01) |
| ***C22C 38/14*** | (2006.01) |
| ***C22C 38/18*** | (2006.01) |
| ***C21D 8/02*** | (2006.01) |
| ***C23C 2/06*** | (2006.01) |
| ***C23C 2/12*** | (2006.01) |
| ***C23C 2/26*** | (2006.01) |
| ***C23C 2/28*** | (2006.01) |
| ***C23C 2/02*** | (2006.01) |
| ***C21D 9/46*** | (2006.01) |
| ***C22C 38/00*** | (2006.01) |
| ***C22C 38/08*** | (2006.01) |
| ***C22C 38/16*** | (2006.01) |
| ***C22C 38/22*** | (2006.01) |
| ***C22C 38/28*** | (2006.01) |
| ***C22C 38/32*** | (2006.01) |
| ***C22C 38/38*** | (2006.01) |
| *C21D 1/673* | (2006.01) |

(52) U.S. Cl.

CPC ..... *C21D 8/0284* (2013.01); *C21D 9/46* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/18* (2013.01); *C22C 38/22* (2013.01); *C22C 38/28* (2013.01); *C22C 38/32* (2013.01); *C22C 38/38* (2013.01); *C23C 2/02* (2013.01); *C23C 2/06* (2013.01); *C23C 2/12* (2013.01); *C23C 2/26* (2013.01); *C23C 2/28* (2013.01); *C21D 1/673* (2013.01); *C21D 2211/008* (2013.01); *Y10T 428/12757* (2015.01); *Y10T 428/12799* (2015.01)

(56) References Cited

U.S. PATENT DOCUMENTS

| | | | | |
|---|---|---|---|---|
| 2012/0175028 | A1* | 7/2012 | Matsuda | C21D 8/0205 148/645 |
| 2013/0095347 | A1* | 4/2013 | Kawasaki | B32B 15/013 428/684 |

FOREIGN PATENT DOCUMENTS

| | | | | |
|---|---|---|---|---|
| CN | 101939457 | | 1/2011 | |
| CN | 102227511 | | 10/2011 | |
| EP | 2128295 | | 12/2009 | |
| EP | 2264206 | | 12/2010 | |
| JP | 01-172524 | | 7/1989 | |
| JP | 06-128688 | | 5/1994 | |
| JP | 11-189842 | | 7/1999 | |
| JP | 2000-319756 | | 11/2000 | |
| JP | 2001-355044 | | 12/2001 | |
| JP | 2003-193192 | | 7/2003 | |
| JP | 2004-018912 | | 1/2004 | |
| JP | 2005-120436 | | 5/2005 | |
| JP | 2005-256141 | | 9/2005 | |
| JP | 2007314817 | | 12/2007 | |
| JP | 2008-156734 | * | 7/2008 | C22C 38/00 |
| JP | 2008156734 | | 7/2008 | |
| JP | 2010-065292 | | 3/2010 | |
| JP | 2011144409 | | 7/2011 | |
| JP | 2003-313636 | | 11/2013 | |
| RU | 2312162 | C2 | 12/2007 | |
| RU | 2312920 | C2 | 12/2007 | |
| RU | 2379373 | C1 | 1/2010 | |
| RU | 2395593 | C1 | 7/2010 | |
| RU | 2403311 | C2 | 11/2010 | |
| RU | 2437945 | C2 | 6/2011 | |
| RU | 2437945 | C2 | 12/2011 | |
| RU | 2439189 | C1 | 1/2012 | |
| WO | 2011013845 | | 2/2011 | |
| WO | 2011/025042 | A1 | 3/2011 | |
| WO | WO2011/087057 | | 7/2011 | |
| WO | WO 2011/132763 | A1 | 10/2011 | |
| WO | 2011142356 | | 11/2011 | |
| WO | WO2011/158818 | | 12/2011 | |

OTHER PUBLICATIONS

Machine-English translation of JP 2010-065292, Kobayashi Satoo et al., Sep. 12, 2008.*

Office Action dated Oct. 8, 2015 issued in corresponding Korean Application No. 10-2014-7019659.

Office Action dated Oct. 8, 2015 issued in related Korean Application No. 10-2014-7019669.

Notice of Allowance issued on Nov. 27, 2015 in corresponding RU Application No. 2014129328.

Notice of Allowance issued on Nov. 27, 2015 in corresponding RU Application No. 2014129326.

Office Action issued on Nov. 30, 2015 in corresponding CA Application No. 2,862,810.

Search Report dated Feb. 17, 2016 issued in corresponding European Application No. 13736290.1.

Search Report dated May 2, 2016 issued in corresponding European Application No. 13735919.6.

Office Action dated Jun. 10, 2016 issued in related U.S. Appl. No. 14/371,214.

Office Action dated Aug. 19, 2015 issued in Chinese Application No. 201380005142.0. [with English Translation].

Office Action dated Aug. 28, 2015 issued in Chinese Application No. 201380005178.9. [with English Translation].

International Search Report dated Apr. 16, 2013 issued in corresponding PCT Application No. PCT/JP2013/050382 [with English Translation].

International Search Report dated Apr. 16, 2013 issued in PCT Application No. PCT/JP2013/050377 [with English Translation].

Office Action dated Apr. 24, 2014 issued in Taiwanese Application No. 102101294 [with English Translation].

Office Action dated Apr. 24, 2014 issued in Taiwanese Application No. 102101296 [with English Translation].

Canadian Office Action dated Jun. 28, 2016 for Canadian Application No. 2,862,810.

* cited by examiner

HOT STAMPED STEEL AND METHOD FOR PRODUCING THE SAME

TECHNICAL FIELD OF THE INVENTION

The present invention relates to a hot stamped steel having an excellent formability for which a cold rolled steel sheet for hot stamping is used, and a method for producing the same. The cold rolled steel sheet of the present invention includes a cold rolled steel sheet, a hot dip galvanized cold rolled steel sheet, a galvannealed cold rolled steel sheet, an electrogalvanized cold rolled steel sheet and an aluminized cold rolled steel sheet.

This application is a national stage application of International Application No. PCT/JP2013/050377, filed Jan. 11, 2013, which claims priority to Japanese Patent Application No. 2012-004552, filed on Jan. 13, 2012, each of which is incorporated by reference in its entirety.

RELATED ART

Currently, a steel sheet for a vehicle is required to be improved in terms of collision safety and have a reduced weight. Currently, there is demand for a higher-strength steel sheet in addition to a 980 MPa (980 MPa or higher)-class steel sheet and an 1180 MPa (1180 MPa or higher)-class steel sheet in terms of a tensile strength. For example, there is a demand for a steel sheet having a tensile strength of more than 1.5 GPa. In the above-described circumstance, hot stamping (also called hot pressing, diequenching, press quenching or the like) is drawing attention as a method for obtaining a high strength. The hot stamping refers to a forming method in which a steel sheet is heated at a temperature of 750° C. or more, hot-formed (worked) so as to improve a formability of a high-strength steel sheet, and then cooled so as to quench the steel sheet, thereby obtaining desired material qualities.

A steel sheet having a ferrite and martensite, a steel sheet having a ferrite and bainite, a steel sheet containing retained austenite in the structure or the like is known as a steel sheet having both a press workability and a high strength. Among the above-described steel sheets, a multi-phase steel sheet having a martensite dispersed in a ferrite base (a steel sheet including a ferrite and the martensite, that is, a so-called DP steel sheet) has a low yield ratio and a high tensile strength, and furthermore, has excellent elongation characteristics. However, the multi-phase steel sheet has a poor hole expansibility since stress concentrates at an interface between the ferrite and the martensite, and cracking is likely to originate from the interface. In addition, a steel sheet having the above-described multi-phases is not capable of exhibiting a 1.5 GPa-class tensile strength.

For example, Patent Documents 1 to 3 disclose the above-described multi-phase steel sheets. In addition, Patent Documents 4 to 6 describe a relationship between a hardness and the formability of the high-strength steel sheet.

However, even with the above-described techniques of the related art, it is difficult to satisfy current requirements for a vehicle such as an additional reduction of a weight, an additional increase in a strength and a more complicated component shape and a working performance such as the hole expansibility after the hot stamping.

PRIOR ART DOCUMENT

Patent Document

[Patent Document 1] Japanese Unexamined Patent Application, First Publication No. H6-128688

[Patent Document 2] Japanese Unexamined Patent Application, First Publication No. 2000-319756

[Patent Document 3] Japanese Unexamined Patent Application, First Publication No. 2005-120436

[Patent Document 4] Japanese Unexamined Patent Application, First Publication No. 2005-256141

[Patent Document 5] Japanese Unexamined Patent Application, First Publication No. 2001-355044

[Patent Document 6] Japanese Unexamined Patent Application, First Publication No. H11-189842

DISCLOSURE OF THE INVENTION

Problems to be Solved by the Invention

The present invention has been made in consideration of the above-described problem. That is, an object of the present invention is to provide a hot stamped steel for which a cold rolled steel sheet for hot stamping (including a galvanized steel sheet or an aluminized steel sheet as described below) is used and which ensures a strength of 1.5 GPa or more, preferably 1.8 GPa or more, and more preferably 2.0 GPa or more and has a more favorable hole expansibility, and a method for producing the same. Here, the hot stamped steel refers to a molded article obtained by using the above-described cold rolled steel sheet for hot stamping as a material and forming the material through hot stamping.

Means for Solving the Problem

The present inventors first carried out intensive studies regarding a cold rolled steel sheet for hot stamping used for a hot stamped steel which ensures a strength of 1.5 GPa or more, preferably 1.8 GPa or more, and more preferably 2.0 GPa or more and has an excellent formability (hole expansibility), and hot stamping conditions. As a result, it was found that, in the cold rolled steel sheet for hot stamping (the cold rolled steel sheet before the hot stamping), a more favorable formability than ever, that is, a product of a tensile strength TS and a hole expansion ratio λ (TS×λ) of 50000 MPa·% or more can be ensured by (i), with regard to a steel composition, establishing an appropriate relationship among an amount of Si, an amount of Mn and an amount of C, (ii) adjusting a fraction (area fraction) of a ferrite and a fraction (area fraction) of a martensite to predetermined fractions, and (iii) adjusting a rolling reduction of cold-rolling so as to set a hardness ratio (a difference of a hardness) of the martensite between a surface portion of a sheet thickness (surface part) and a center portion of the sheet thickness (central part) of the steel sheet and a hardness distribution of the martensite in the central part in a specific range. The cold rolled steel sheet before the hot stamping refers to a cold rolled steel sheet in a state in which a heating in a hot stamping process in which the steel sheet is heated to 750° C. to 1000° C., worked and cooled is about to be carried out. In addition, it was found that, when the hot stamping is carried out on the cold rolled steel sheet for hot stamping under the hot stamping conditions described below, the hardness ratio of the martensite between the surface portion of the sheet thickness and the central part of the steel sheet and the hardness distribution of the martensite in the central part are almost maintained even after the hot stamping, and a hot stamped steel having a high strength and an excellent formability in which TS×λ reaches 50000 MPa·% or more can be obtained. In addition, it was also clarified that it is also effective to suppress a segregation of MnS in the central part of the sheet thickness of the cold rolled steel sheet for hot stamping to improve the formability (hole expansibility) of the hot stamped steel.

In addition, it was also found that, in cold-rolling, it is also effective to adjust a fraction of a cold-rolling reduction in each stand from an uppermost stand to a third stand in a total cold-rolling reduction (cumulative rolling reduction) to a specific range to control the hardness of the martensite. Based on the above-described finding, the inventors have found a variety of aspects of the present invention described below. In addition, it was found that the effects are not impaired even when hot dip galvanizing, galvannealing, electrogalvanizing and aluminizing are carried out on the cold rolled steel sheet for hot stamping.

(1) That is, according to a first aspect of the present invention, there is provided a hot stamped steel including, by mass %, C: more than 0.150% to 0.300%, Si: 0.010% to 1.000%, Mn: 1.50% to 2.70%, P: 0.001% to 0.060%, S: 0.001% to 0.010%, N: 0.0005% to 0.0100%, Al: 0.010% to 0.050%, and optionally one or more of B: 0.0005% to 0.0020%, Mo: 0.01% to 0.50%, Cr: 0.01% to 0.50%, V: 0.001% to 0.100%, Ti: 0.001% to 0.100%, Nb: 0.001% to 0.050%, Ni: 0.01% to 1.00%, Cu: 0.01% to 1.00%, Ca: 0.0005% to 0.0050%, REM: 0.0005% to 0.0050%, and a balance including Fe and unavoidable impurities, in which, when [C] represents an amount of C by mass %, [Si] represents an amount of Si by mass %, and [Mn] represents an amount of Mn by mass %, a following expression-a is satisfied, a metallographic structure includes 80% or more of a martensite in an area fraction, and optionally, further includes one or more of 10% or less of a pearlite in an area fraction, 5% or less of a retained austenite in a volume ratio, 20% or less of a ferrite in an area fraction, and less than 20% of a bainite in an area fraction, TS×λ which is a product of TS that is a tensile strength and λ that is a hole expansion ratio is 50000 MPa·% or more, and a hardness of the martensite measured with a nanoindenter satisfies a following expression-b and a following expression-c.

$$5\times[Si]+[Mn])/[C]>10 \quad (a)$$

$$H2/H1<1.10 \quad (b)$$

$$\sigma HM<20 \quad (c)$$

Here, the H1 represents an average hardness of the martensite in a surface portion, the H2 represents the average hardness of the martensite in a center part of a sheet thickness that is an area having a width of ±100 μm in a thickness direction from a center of the sheet thickness, and the σHM represents a variance of the hardness of the martensite existing in the central part of the sheet thickness.

(2) In the hot stamped steel according to the above (1), an area fraction of a MnS existing in the metallographic structure and having an equivalent circle diameter of 0.1 μm to 10 μm may be 0.01% or less, and a following expression-d may be satisfied.

$$n2/n1<1.5 \quad (d)$$

Here, the n1 represents an average number density per 10000 $\mu m^2$ of the MnS in a ¼ part of the sheet thickness, and the n2 represents an average number density per 10000 $\mu m^2$ of the MnS in the central part of the sheet thickness.

(3) In the hot stamped steel according to the above (1) or (2), a hot dip galvanizing may be formed on a surface thereof.

(4) In the hot stamped steel according to the above (3), the hot dip galvanized layer may include galvannealing.

(5) In the hot stamped steel according to the above (1) or (2), an electrogalvanizing may be further formed on a surface thereof.

(6) In the hot stamped steel according to the above (1) or (2), an aluminizing may be further formed on a surface thereof.

(7) According to another aspect of the present invention, there is provided a method for producing a hot stamped steel including casting a molten steel having a chemical composition according to the above (1) and obtain a steel; heating the steel; hot-rolling the steel with a hot-rolling facility having a plurality of stands; coiling the steel after the hot-rolling; pickling the steel after the coiling; cold-rolling the steel after the pickling with a cold rolling mill having a plurality of stands under a condition satisfying a following expression-e; annealing in which the steel is heated under 700° C. to 850° C. and cooled after the cold-rolling; temper-rolling the steel after the annealing; and hot stamping in which the steel is heated to a temperature range of 750° C. or more at a temperature-increase rate of 5° C./second or more, formed within the temperature range, and cooled to 20° C. to 300° C. at a cooling rate of 10° C./second or more after the temper-rolling.

$$1.5\times r1/r+1.2\times r2/r+r3/r>1 \quad (e)$$

Here, r1 represents an individual cold-rolling reduction (%) at an $i^{th}$ stand based on an uppermost stand among a plurality of the stands in the cold-rolling process where i is 1, 2 or 3, and r represents a total cold-rolling reduction (%) in the cold-rolling.

(8) In the method for producing the hot stamped steel according to the above (7), when CT (° C.) represents a coiling temperature in the coiling; [C] represents an amount of C by mass %, [Si] represents an amount of Si by mass %, [Mn] represents an amount of Mn by mass % in the steel; and [Mo] represents an amount of Mo by mass % in the steel, a following expression-f may be satisfied.

$$560-474\times[C]-90\times[Mn]-20\times[Cr]-20\times[Mo]<CT<830-270\times[C]-90\times[Mn]-70\times[Cr]-80\times[Mo] \quad (f)$$

(9) In the method for producing the hot stamped steel according to the above (7) or (8), when T (° C.) represents a heating temperature in the heating; r (minutes) represents an in-furnace time; and [Mn] represents an amount of Mn by mass %, and [S] represents an amount of S by mass % in the steel, a following expression-g may be satisfied.

$$T\times\ln(t)/(1.7\times[Mn]+[S])>1500 \quad (g)$$

(10) The method for producing the hot stamped steel according to any one of the above (7) to (9) may further include galvanizing between the annealing and the temper-rolling.

(11) The method for producing the hot stamped steel according to the above (10) may further include alloying between the hot dip galvanizing and the temper-rolling.

(12) The method for producing the hot stamped steel according to any one of the above (7) to (9) may further include electrogalvanizing between the temper-rolling and the hot stamping.

(13) The method for producing the hot stamped steel according to any one of the above (7) to (9) may further include aluminizing between the annealing and the temper-rolling.

Effects of the Invention

According to the present invention, since an appropriate relationship is established among the amount of the C, the amount of the Mn and the amount of the Si, and the hardness of the martensite measured with a nanoindenter is set to an appropriate value in the molded article after the hot stamping, it is possible to obtain a hot stamped steel having a favorable hole expansibility.

EMBODIMENTS OF THE INVENTION

Figure 1:
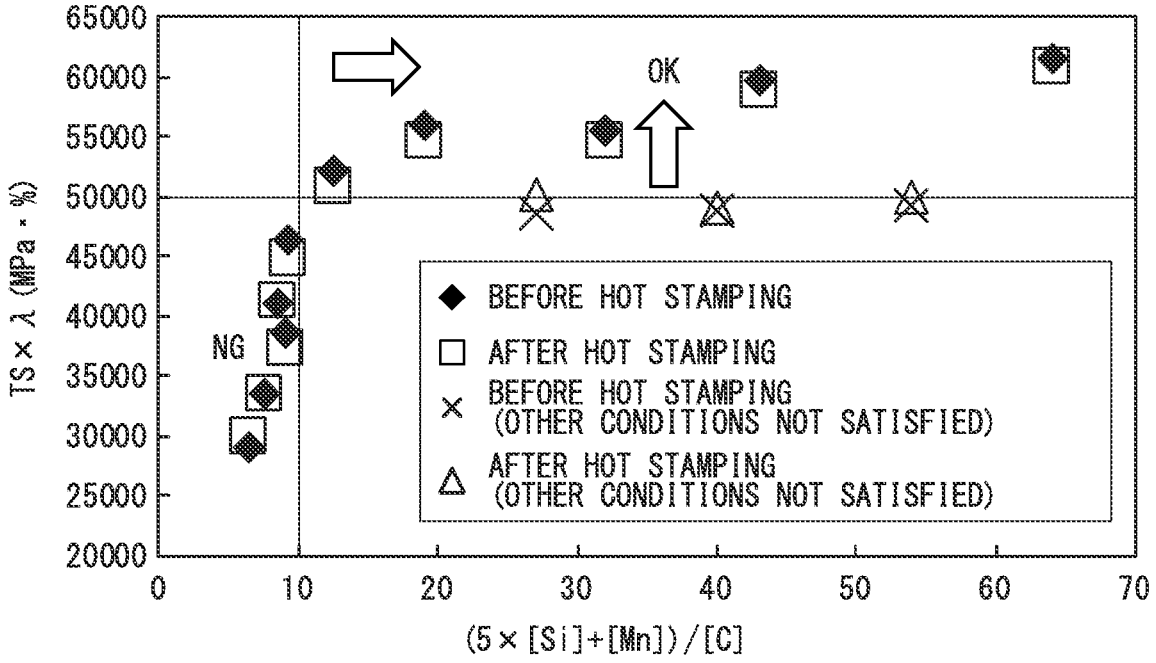
FIG. 1 is a graph illustrating a relationship between (5×[Si]+[Mn])/[C] and TS×λ.

As described above, it is important to establish an appropriate relationship among an amount of Si, an amount of Mn and an amount of C, and furthermore, to set an appropriate hardness of a martensite at a predetermined position to improve a formability (hole expansibility) of a hot stamped steel. Thus far, there have been no studies regarding a relationship between the formability of the hot stamped steel and the hardness of the martensite.

Hereinafter, an embodiment of the present invention will be described in detail.

First, reasons for limiting a chemical composition of a cold rolled steel sheet for hot stamping (including a hot dip galvanized cold rolled steel sheet or an aluminized cold rolled steel sheet and, in some cases, referred to as a cold rolled steel sheet according to the embodiment or simply as a cold rolled steel sheet for hot stamping) used for a hot stamped steel according to an embodiment of the present invention (the hot stamped steel according to the present embodiment or, in some cases, referred to simply as the hot stamped steel) will be described. Hereinafter, "%" that is a unit of an amount of an individual component indicates "mass %". Since a component amount of a chemical composition of the steel sheet does not change in the hot stamping, the chemical composition is identical in both the cold rolled steel sheet and the hot stamped steel for which the cold rolled steel sheet is used.

C: more than 0.150% to 0.300%

C is an important element to strengthen a ferrite and the martensite and increase a strength of a steel. However, when an amount of the C is 0.150% or less, a sufficient amount of a martensite cannot be obtained, and it is not possible to sufficiently increase the strength. On the other hand, when the amount of the C exceeds 0.300%, an elongation and the hole expansibility significantly degrades. Therefore, a range of the amount of the C is set to more than 0.150% and 0.300% or less.

Si: 0.010% to 1.000%

Si is an important element to suppress a generation of a harmful carbide and to obtain multi-phases mainly including the ferrite and the martensite. However, when an amount of the Si exceeds 1.000%, elongation or hole expansibility degrades, and a chemical conversion property also degrades. Therefore, the amount of the Si is set to 1.000% or less. In addition, the Si is added for deoxidation, but a deoxidation effect is not sufficient at the amount of the Si of less than 0.010%. Therefore, the amount of the Si is set to 0.010% or more.

Al: 0.010% to 0.050%

Al is an important element as a deoxidizing agent. To obtain the deoxidation effect, an amount of the Al is set to 0.010% or more. On the other hand, even when the Al is excessively added, the above-described effect is saturated, and conversely, the steel becomes brittle, and TS×λ is decreased. Therefore, the amount of the Al is set in a range of 0.010% to 0.050%.

Mn: 1.50% to 2.70%

Mn is an important element to improve a hardenability and strengthen the steel. However, when an amount of the Mn is less than 1.50%, it is not possible to sufficiently increase the strength. On the other hand, when the amount of the Mn exceeds 2.70%, the hardenability becomes excessive, and the elongation or the hole expansibility degrades. Therefore, the amount of the Mn is set to 1.50% to 2.70%. In a case in which higher elongation is required, the amount of the Mn is desirably set to 2.00% or less.

P: 0.001% to 0.060%

At a large amount, P segregates at grain boundaries, and deteriorates a local elongation and a weldability. Therefore, an amount of the P is set to 0.060% or less. The amount of the P is desirably smaller, but an extreme decrease in the amount of the P leads to a cost increase for refining, and therefore the amount of the P is desirably set to 0.001% or more.

S: 0.001% to 0.010%

S is an element that forms MnS and significantly deteriorates the local elongation or the weldability. Therefore, an upper limit of an amount of the S is set to 0.010%. In addition, the amount of the S is desirably smaller; however, due to a problem of a refining cost, a lower limit of the amount of the S is desirably set to 0.001%.

N: 0.0005% to 0.0100%

N is an important element to precipitate AlN and the like and miniaturize crystal grains. However, when an amount of the N exceeds 0.0100%, a nitrogen solid solution remains and elongation or hole expansibility is degraded. Therefore, an amount of the N is set to 0.0100% or less. The amount of the N is desirably smaller; however, due to a problem of a refining cost, a lower limit of the amount of the N is desirably set to 0.0005%.

The cold rolled steel sheet according to the embodiment has a basic composition including the above-described elements and a balance including iron and unavoidable impurities, however, in some cases, includes at least one element of Nb, Ti, V, Mo, Cr, Ca, REM (rare earth metal), Cu, Ni and B as elements that have thus far been used in an amount that is equal to or less than an upper limit described below to improve the strength, to control a shape of a sulfide or an oxide, and the like. The above-described chemical elements are not necessarily added to the steel sheet, and therefore a lower limit thereof is 0%.

Nb, Ti and V are elements that precipitate a fine carbonitride and strengthen the steel. In addition, Mo and Cr are elements that increase the hardenability and strengthen the steel. To obtain the above-described effects, it is desirable to include Nb: 0.001% or more, Ti: 0.001% or more, V: 0.001% or more, Mo: 0.01% or more and Cr: 0.01% or more. However, even when Nb: more than 0.050%, Ti: more than 0.100%, V: more than 0.100%, Mo: more than 0.50%, and Cr: more than 0.50% are contained, a strength-increasing effect is saturated, and the degradation of the elongation or the hole expansibility is caused. Therefore, upper limits of Nb, Ti, V, Mo and Cr are set to 0.050%, 0.100%, 0.100%, 0.50% and 0.50%, respectively.

Ca controls the shape of the sulfide or the oxide and improves the local elongation or the hole expansibility. To obtain the above-described effect, it is desirable to contain 0.0005% or more of the Ca. However, since an excessive addition deteriorates a workability, an upper limit of an amount of the Ca is set to 0.0050%.

Similarly to Ca, rare earth metal (REM) controls the shape of the sulfide and the oxide and improves the local elongation or the hole expansibility. To obtain the above-described effect, it is desirable to contain 0.0005% or more of the REM. However, since an excessive addition deteriorates the workability, an upper limit of an amount of the REM is set to 0.0050%.

The steel can further include Cu: 0.01% to 1.00%, Ni: 0.01% to 1.00% and B: 0.0005% to 0.0020%. The above-described elements also can improve the hardenability and increase the strength of the steel. However, to obtain the above-described effect, it is desirable to contain Cu: 0.01% or more, Ni: 0.01% or more and B: 0.0005% or more. In amounts that are equal to or less than the above-described amounts, the effect that strengthens the steel is small. On the other hand, even when Cu: more than 1.00%, Ni: more than 1.00% and B: more than 0.0020% are added, the strength-increasing effect is saturated, and the elongation or the hole expansibility degrades. Therefore, an upper limit of an amount of the Cu is set to 1.00%, an upper limit of an amount of the Ni is set to 1.00%, and an upper limit of an amount of B is set to 0.0020%.

In a case in which B, Mo, Cr, V, Ti, Nb, Ni, Cu, Ca and REM are included, at least one element is included. The balance of the steel includes Fe and unavoidable impurities. As the unavoidable impurities, elements other than the above-described elements (for example, Sn, As and the like) may be further included as long as characteristics are not impaired. When B, Mo, Cr, V, Ti, Nb, Ni, Cu, Ca and REM are included in amounts that is less than the above-described lower limits, the elements are treated as the unavoidable impurities.

Furthermore, in the hot stamped steel according to the embodiment, when [C] represents the amount of the C (mass %), [Si] represents the amount of Si (mass %) and [Mn] represents the amount of Mn (mass %), it is important to satisfy the following expression a to obtain the sufficient hole expansibility as illustrated in FIG. 1.

$$(5\times[Si]+[Mn])/[C]>10 \quad (a)$$

When a value of $(5\times[Si]+[Mn])/[C]$ is 10 or less, $TS\times\lambda$ becomes less than 50000 MPa·%, and it is not possible to obtain the sufficient hole expansibility. This is because, when the amount of the C is high, a hardness of a hard phase becomes too high and a difference between a hardness of a hard phase and a hardness of a soft phase becomes great, and thereby, a value of $\lambda$ is deteriorated, and, when the amount of the Si or the amount of the Mn is small, TS becomes low. Therefore, it is necessary to set the each element in the above-described ranges, and furthermore, to control a balance among the amounts thereof Since the value of $(5\times[Si]+[Mn])/[C]$ does not change even after hot stamping as described above, the value is preferably satisfied when producing the cold rolled steel sheet. However, even when $(5\times[Si]+[Mn])/[C]>10$ is satisfied, in a case in which the H2/H1 or the σHM described below does not satisfy the conditions, the sufficient hole expansibility cannot be obtained. In FIG. 1, a reference sign for after the hot stamping indicates the hot stamped steel, and a reference sign for before the hot stamping indicates the cold rolled steel sheet for hot stamping.

Figure 2A:
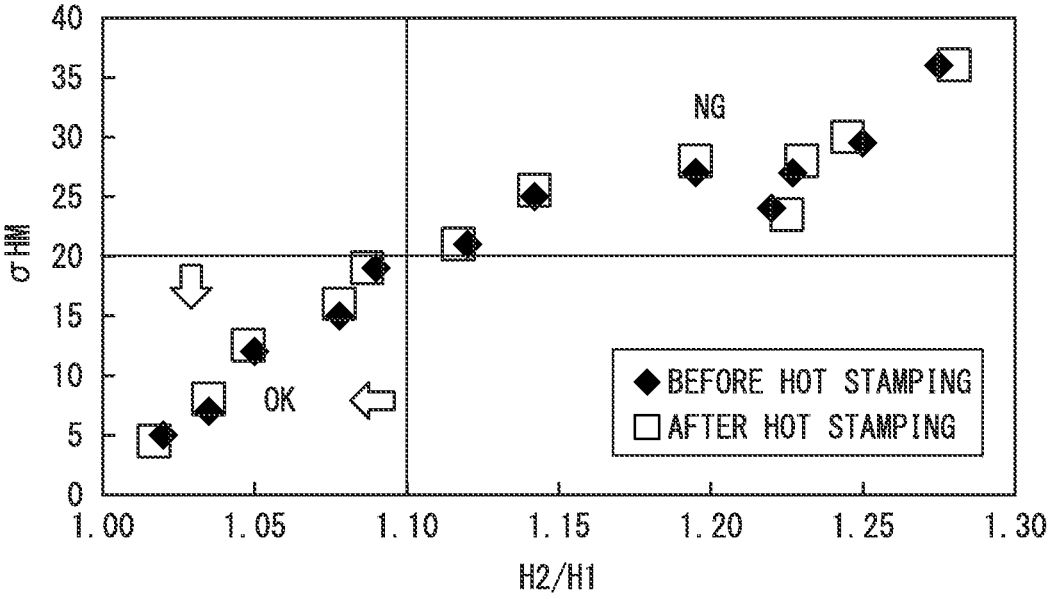
FIG. 2A is a graph illustrating a foundation of an expression b and an expression c, and is a graph illustrating a relationship between H2/H1 and σHM of a hot stamped steel.
Figure 2B:
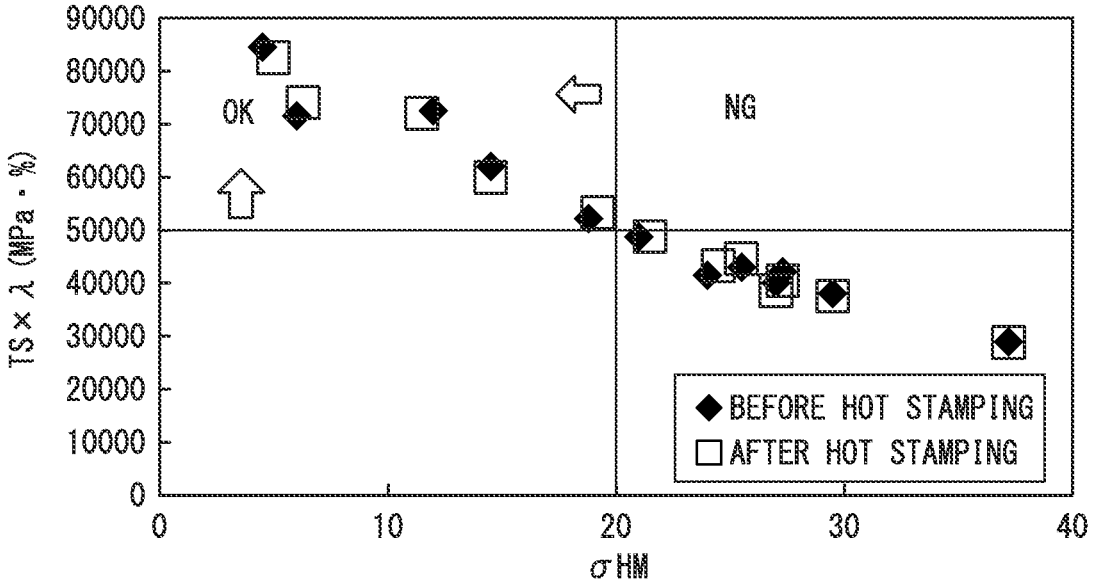
FIG. 2B is a graph illustrating a foundation of the expression c, and is a graph illustrating a relationship between the σHM and TS×λ.

Generally, it is the martensite rather than the ferrite to dominate the formability (hole expansibility) in the cold rolled steel sheet having the metallographic structure mainly including the ferrite and the martensite. The inventors carried out intensive studies regarding a relationship between the hardness and the formability such as the elongation or the hole expansibility of the martensite. As a result, it was found that, when a hardness ratio (a difference of the hardness) of the martensite between a surface portion of a sheet thickness and a central part of the sheet thickness, and a hardness distribution of the martensite in the central part of the sheet thickness are in a predetermined state regarding a hot stamp formability according to the embodiment as illustrated in FIGS. 2A and 2B, the formability such as the elongation or the hole expansibility becomes favorable. In addition, it was clarified that, when the hardness ratio and the hardness distribution are in a predetermined range in the cold rolled steel sheet for hot stamping used for the hot stamp formability according to the embodiment, the hardness ratio and the hardness distribution are almost maintained in the hot stamped steel as well, and the formability such as the elongation or the hole expansibility becomes favorable. This is because the hardness distribution of the martensite formed in the cold rolled steel sheet for hot stamping also has a significant effect on the hot stamped steel after the hot stamping. Specifically, this is considered to be because alloy elements condensed in the central part of the sheet thickness still hold a state of being condensed in the central part even after the hot stamping is carried out. That is, in the cold rolled steel sheet for hot stamping, in a case in which the hardness difference of the martensite between the surface portion of the sheet thickness and the central part of the sheet thickness is great or a case in which a variance of the hardness of the martensite is great in the central part of the sheet thickness, the similar hardness ratio and the similar variance are obtained in the hot stamped steel as well. In FIGS. 2A and 2B, a reference sign for after the hot stamping indicates the hot stamped steel, and a reference sign for before the hot stamping indicates the cold rolled steel sheet for hot stamping.

The inventors also found that, regarding a hardness measurement of the martensite measured with a nanoindenter manufactured by Hysitron Corporation at 1000 times, when the following expression b and the following expression c are satisfied, the formability of the hot stamped steel improves. Here, an "H1" is the hardness of the martensite in the surface portion of the sheet thickness that is within an area having a width of 200 μm in a thickness direction from an outermost layer of the hot stamped steel. An "H2" is the hardness of the martensite in the central part of the sheet thickness of the hot stamped steel, that is, in an area having a width of ±100 μm in the thickness direction from the central part of the sheet thickness. A "σHM" is the variance of the hardness of the martensite existing in an area having a width of 200 μm in the thickness direction in the central part of the sheet thickness of the hot stamped steel. The H1, the H2 and the σHM are each obtained from 300-point measurements. The area having a width of 200 μm in the thickness direction in the central part of the sheet thickness refers to an area having a center at a center of the sheet thickness and having a dimension of 200 μm in the thickness direction.

$$H2/H1<1.10 \quad \text{(b)}$$

$$\sigma HM<20 \quad \text{(c)}$$

In addition, here, the variance is a value obtained using the following expression h and indicating a distribution of the hardness of the martensite.

[Expression 1]

$$\sigma HM = \frac{1}{n}\sum_{i=1}^{n}(x_{ave} - x_i)^2 \quad \text{(h)}$$

An $X_{ave}$ represents an average value of the measured hardness of the martensite, and $X_i$ represents the hardness of an $i^{th}$ martensite.

FIG. 2A illustrates the ratios between the hardness of the martensite in the surface portion and the hardness of the martensite in the central part of the sheet thickness of the hot stamped steel and the cold rolled steel sheet for hot stamping. In addition, FIG. 2B collectively illustrates the variance of the hardness of the martensite existing in the width of ±100 μm in the sheet thickness direction from the center of the sheet thickness of the hot stamped steel and the cold rolled steel sheet for hot stamping. As illustrated in FIGS. 2A and 2B, the hardness ratio of the cold rolled steel sheet before the hot stamping and the hardness ratio of the cold rolled steel sheet after the hot stamping are almost the same. In addition, the variances of the hardness of the martensite in the central part of the sheet thickness are also almost the same both in the cold rolled steel sheet before the hot stamping and in the cold rolled steel sheet after the hot stamping.

In the hot stamped steel, a value of the H2/H1 being 1.10 or more represents that the hardness of the martensite in the central part of the sheet thickness is 1.10 or more times the hardness of the martensite in the surface portion of the sheet thickness. That is, this indicates that the hardness in the central part of the sheet thickness becomes too high. As illustrated in FIG. 2A, when the H2/H1 is 1.10 or more, the σHM reaches 20 or more. In this case, TS×λ becomes less than 50000 MPa·%, and a sufficient formability cannot be obtained after quenching, that is, in the hot stamped steel. Theoretically, there is a case in which a lower limit of the H2/H1 becomes the same in the central part of the sheet thickness and in the surface portion of the sheet thickness unless a special thermal treatment is carried out; however, in an actual production process in consideration of a productivity, the lower limit is, for example, up to approximately 1.005.

The variance σHM of the hot stamped steel being 20 or more indicates that a variation of the hardness of the martensite is large, and parts in which the hardness is too high locally exist. In this case, TS×λ becomes less than 50000 MPa·%. That is, a sufficient formability cannot be obtained in the hot stamped steel.

Next, the metallographic structure of the hot stamped steel according to the embodiment will be described. An area fraction of the martensite is 80% or more in the hot stamped steel according to the embodiment. When the area fraction of the martensite is less than 80%, a sufficient strength that has been recently required for the hot stamped steel (for example, 1.5 GPA) cannot be obtained. Therefore, the area fraction of the martensite is set to 80% or more. All or principal parts of the metallographic structure of the hot stamped steel are occupied by the martensite, and may further include one or more of 0% to 10% of a pearlite in an area fraction, 0% to 5% of a retained austenite in a volume ratio, 0% to 20% of the ferrite in an area fraction, and 0% to less than 20% of a bainite in an area fraction. While there is a case in which 0% to 20% of the ferrite exists depending on a hot stamping condition, there is no problem with the strength after the hot stamping within the above-described range. When the retained austenite remains in the metallographic structure, a secondary working brittleness and a delayed fracture characteristic are likely to degrade. Therefore, it is preferable that the residual austenite is substantially not included; however, unavoidably, 5% or less of the residual austenite in a volume ratio may be included. Since the pearlite is a hard and brittle structure, it is preferable not to include the pearlite; however, unavoidably, up to 10% of the pearlite in an area fraction may be included. The bainite is a structure that can be formed as a residual structure, and is an intermediate structure in terms of the strength or the formability, may be included. The bainite may be included up to less than 20% in terms of an area fraction. In the embodiment, the metallographic structures of the ferrite, the bainite and the pearlite were observed through Nital etching, and the metallographic structure of the martensite was observed through Le pera etching. All the metallographic structures were observed in a ¼ part of the sheet thickness with an optical microscope at 1000 times. The volume ratio of the retained austenite was measured with an X-ray diffraction apparatus after polishing the steel sheet up to the ¼ part of the sheet thickness.

Next, the desirable metallographic structure of the cold rolled steel sheet for hot stamping for which the hot stamped steel according to the embodiment is used will be described. The metallographic structure of the hot stamped steel is affected by the metallographic structure of the cold rolled steel sheet for hot stamping. Therefore, when the metallographic structure of the cold rolled steel sheet for hot stamping is controlled, it becomes easy to obtain the above-described metallographic structure in the hot stamped steel. In the cold rolled steel sheet according to the embodiment, the area fraction of the ferrite is desirably 40% to 90%. When the area fraction of the ferrite is less than 40%, the strength becomes too high even before the hot stamping and there is a case in which the shape of the hot stamped steel deteriorates or cutting becomes difficult. Therefore, the area fraction of the ferrite before the hot stamping is desirably set to 40% or more. In addition, in the cold rolled steel sheet according to the embodiment, since an amount of alloy elements is great, it is difficult to set the area fraction of the ferrite to more than 90%. In the metallographic structure, in addition to the ferrite, the martensite is included, and the area fraction thereof is desirably 10% to 60%. A total of the area fraction of the ferrite and the area fraction of the martensite is desirably 60% or more before the hot stamping. The metallographic structure may further include one or more of the pearlite, the bainite and the retained austenite. However, when the retained austenite remains in the metallographic structure, the secondary working brittleness and the delayed fracture characteristics are likely to degrade, and therefore it is preferable that the retained austenite be substantially not included. However, unavoidably, 5% or less of the retained austenite may be included in a volume ratio. Since the pearlite is a hard and brittle structure, the pearlite is preferably not included; however, unavoidably, up to 10% of the pearlite may be included in an area fraction. Up to 20% or less of the bainite as the residual structure can be included in an area fraction for the same reason as described above. Similarly to the cold rolled steel sheet before the hot stamping, the metallographic structures of the ferrite, the bainite and the pearlite were observed through Nital etching, and the metallographic structure of the martensite was observed through Le pera etching. All the metallographic structures were observed in a ¼ part of the sheet thickness with an optical microscope at 1000 times. The volume ratio of the retained austenite was measured with an X-ray diffraction apparatus after polishing the steel sheet up to the ¼ part of the sheet thickness.

In addition, in the hot stamped steel according to the embodiment, the hardness of the martensite measured with a nanoindenter at 1000 times (indentation hardness (GPa or $N/mm^2$) or a value obtained by converting the indentation hardness to a Vickers hardness (Hv)) is specified. In an ordinary Vickers hardness test, a formed indentation becomes larger than the martensite. Therefore, a macroscopic hardness of the martensite and peripheral structures thereof (the ferrite and the like) can be obtained, but it is not possible to obtain the hardness of the martensite itself. Since the formability such as the hole expansibility is significantly affected by the hardness of the martensite itself, it is difficult to sufficiently evaluate the formability only with the Vickers hardness. On the contrary, in the hot stamped steel according to the embodiment, since the hardness ratio of the hardness of the martensite measured with the nanoindenter and a dispersion state are controlled in an appropriate range, it is possible to obtain an extremely favorable formability.

Figure 3:
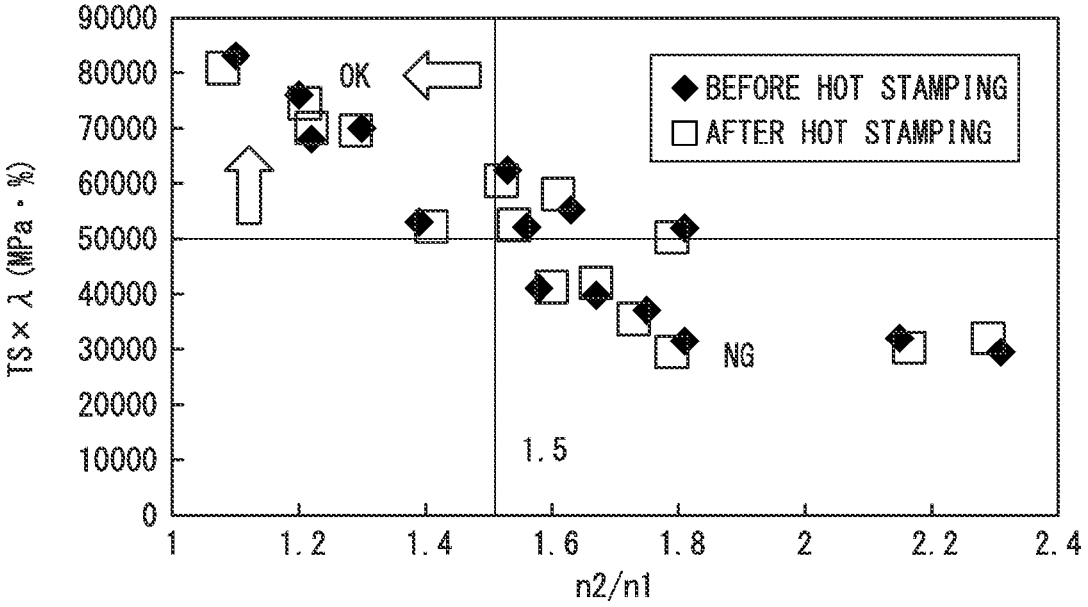
FIG. 3 is a graph illustrating a relationship between n2/n1 and TS×λ before and after hot stamping, and illustrating a foundation of expression d.

The MnS was observed at a location of ¼ of the sheet thickness (a location that is ¼ of the sheet thickness deep from the surface) and the central part of the sheet thickness of the hot stamped steel. As a result, it was found that an area fraction of the MnS having an equivalent circle diameter of 0.1 μm to 10 μm of 0.01% or less and, as illustrated in FIG. 3, the following expression d being satisfied are preferable for favorably and stably obtaining TS×λ≥50000 MPa·%.

$$n2/n1<1.5 \quad \text{(d)}$$

Here, the n1 represents a number density (average number density) (grains/10000 $\mu m^2$) of the MnS having the equivalent circle diameter of 0.1 μm to 10 μm per unit area in the ¼ part of the sheet thickness of the hot stamped steel, and the n2 represents a number density (average number density) (grains/10000 $\mu m^2$) of the MnS having the equivalent circle diameter of 0.1 μm to 10 μm per unit area in the central part of the sheet thickness of the hot stamped steel.

A reason for the formability improving in a case in which the area fraction of MnS of 0.1 μm to 10 μm is 0.01% or less is considered that, when a hole expansion test is carried out, if there is MnS having the equivalent circle diameter of 0.1 μm or more, since stress concentrates in a vicinity thereof, cracking is likely to occur. A reason for not counting the MnS having the equivalent circle diameter of less than 0.1 μm is that an effect on the stress concentration is small, and a reason for not counting the MnS having the equivalent circle diameter of more than 10 μm is that the MnS having the equivalent circle diameter of more than 10 μm is originally not suitable for working. Furthermore, when the area fraction of the MnS having the equivalent circle diameter of 0.1 μm to 10 μm exceeds 0.01%, since it becomes easy for fine cracks generated due to the stress concentration to propagate. Therefore, there is a case in which the hole expansibility degrades. Furthermore, a lower limit of the area fraction of the MnS is not particularly specified, but it is reasonable to set the lower limit to 0.0001% or more since setting the lower limit to less than 0.0001% in consideration of a measurement method described below, limitations of a magnification and a visual field, the amount of the Mn or the S, and a desulfurization treatment capability has an effect on a productivity and a cost.

When the area fraction of MnS having the equivalent circle diameter of 0.1 μm to 10 μm in the hot stamped steel is more than 0.01%, as described above, the formability is likely to degrade due to the stress concentration. A value of the n2/n1 being 1.5 or more in the hot stamped steel indicates that the number density of the MnS in the central part of the sheet thickness of the hot stamped steel is 1.5 or more times the number density of the MnS in the ¼ part of the sheet thickness of the hot stamped steel. In this case, the formability is likely to degrade due to a segregation of the MnS in the central part of the sheet thickness. In the embodiment, the equivalent circle diameter and the number density of the MnS were measured with a field emission scanning electron microscope (Fe-SEM) manufactured by JEOL Ltd. The magnification was 1000 times, and a measurement area of the visual field was set to 0.12×0.09 $mm^2$ (=10800 $\mu m^2$≈10000 $\mu m^2$). 10 visual fields were observed at the location of ¼ of the sheet thickness from the surface (the ¼ part of the sheet thickness), and 10 visual fields were observed in the central part of the sheet thickness. The area fraction of the MnS was computed with particle analysis software. In the embodiment, the MnS was observed in the cold rolled steel sheet for hot stamping in addition to the hot stamped steel. As a result, it was found that a form of the MnS formed before the hot stamping (in the cold rolled steel sheet for hot stamping) did not change even in the hot stamped steel (after the hot stamping). FIG. 3 is a view illustrating a relationship between the n2/n1 and TS×λ of the hot stamped steel, and also illustrates an evaluation of measurement results of the number density of the MnS in the ¼ part of the sheet thickness and in the central part of the sheet thickness of the cold rolled steel sheet for hot stamping using the same index as for the hot stamped steel. In FIG. 3, a reference sign for after the hot stamping indicates the hot stamped steel, and a reference sign for before the hot stamping indicates the cold rolled steel sheet for hot stamping. As illustrated in FIG. 3, the n2/n1 (a ratio of the MnS between the ¼ part of the sheet thickness and the central part of the sheet thickness) of the cold rolled steel sheet for hot stamping and the hot stamped steel is almost the same. This is because the form of the MnS does not change at a heating temperature of the hot stamping.

The hot stamped steel according to the embodiment is obtained, for example, by heating the cold rolled steel sheet according to the embodiment to 750° C. to 1000° C. at a temperature-increase rate of, 5° C./second to 500° C./second, forming (working) the steel sheet for 1 second to 120 seconds, and cooling the steel sheet to a temperature range of 20° C. to 300° C. at a cooling rate of 10° C./second to 1000° C./second. An obtained hot stamped steel has a tensile strength of 1500 MPa to 2200 MPa, and can obtain a significant formability-improving effect, particularly, in a steel sheet having a high strength of approximately 1800 MPa to 2000 MPa.

It is preferable to form a galvanizing, for example, a hot dip galvanizing, a galvannealing, an electrogalvanizing, or an aluminizing on the hot stamped steel according to the embodiment in terms of rust prevention. In a case in which a plating is formed on the hot stamped steel, a plated layer does not change under the above-described hot stamping condition, and therefore a plating may be formed on the cold rolled steel sheet for hot stamping. Even when the above-described plating is formed on the hot stamped steel, the effects of the embodiment are not impaired. The above-described platings can be formed with a well-known method.

Hereinafter, a method for producing the cold rolled steel sheet according to the embodiment and the hot stamped steel according to the embodiment obtained by hot-stamping the cold rolled steel sheet will be described.

When producing the cold rolled steel sheet according to the embodiment, as an ordinary condition, a molten steel melted so as to have the above-described chemical composition is continuously cast after a converter, thereby producing a slab. In the continuous casting, when a casting rate is fast, a precipitate of Ti and the like becomes too fine. On the other hand, when the casting rate is slow, productivity deteriorates, and consequently, the above-described precipitate coarsens so as to decrease the number of particles, and there is a case in which other characteristics such as a delayed fracture cannot be controlled appears. Therefore, the casting rate is desirably 1.0 m/minute to 2.5 m/minute.

The slab after the melting and the casting can be subjected to hot-rolling as cast. Alternatively, in a case in which the slab is cooled to less than 1100° C., it is possible to reheat the slab to 1100° C. to 1300° C. in a tunnel furnace or the like and subject the slab to the hot-rolling. When a temperature of the slab during the hot-rolling is less than 1100° C., it is difficult to ensure a finishing temperature in the hot-rolling, which causes a degradation of the elongation. In addition, in the steel sheet to which Ti or Nb is added, a dissolution of the precipitate becomes insufficient during the heating, which causes a decrease in the strength. On the other hand, when the temperature of the slab is more than 1300° C., a generation of a scale becomes great, and there is a concern that it may be impossible to make the surface quality of the steel sheet favorable.

Figure 6:
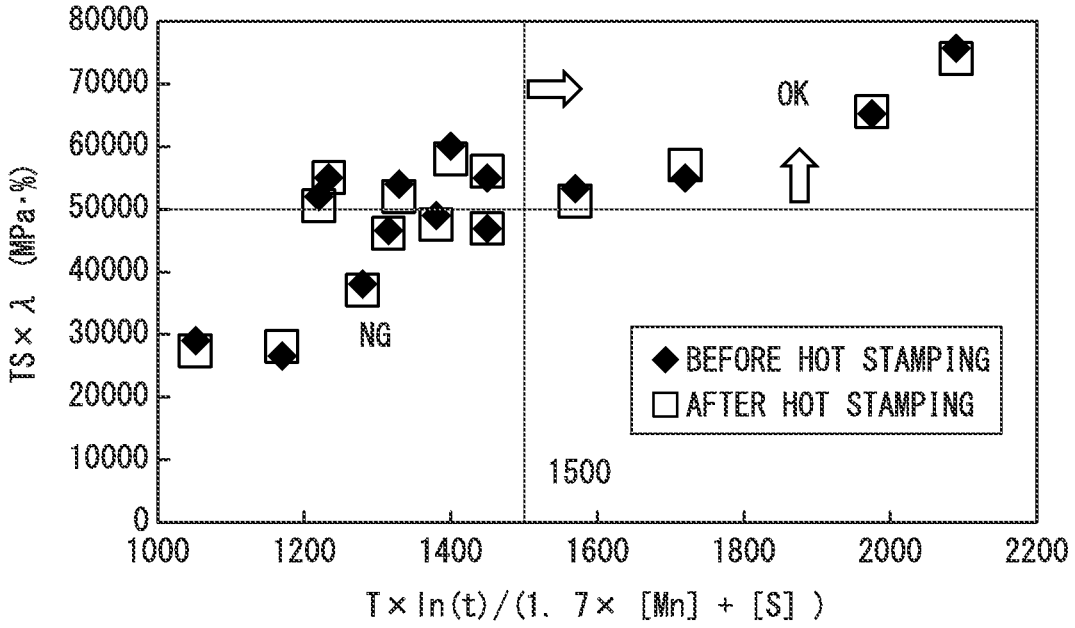
FIG. 6 is a graph illustrating a relationship between T×ln(t)/(1.7×[Mn]+[S]) and TS×λ, and illustrating a foundation of expression g.

In addition, to decrease the area fraction of the MnS, when [Mn] represents the amount of the Mn (mass %) and [S] represent the amount of the S (mass %) in the steel, it is preferable for a temperature T (° C.) of a heating furnace before carrying out the hot-rolling, an in-furnace time t (minutes), [Mn] and [S] to satisfy the following expression g as illustrated in FIG. 6.

$$T\times\ln(t)/(1.7\times[\mathrm{Mn}]+[\mathrm{S}])>1500 \quad \text{(g)}$$

When a value of T×ln(t)/(1.7×[Mn]+[S]) is equal to or less than 1500, the area fraction of the MnS becomes large, and there is a case in which a difference between the number of the MnS in the ¼ part of the sheet thickness and the number of the MnS in the central part of the sheet thickness becomes large. The temperature of the heating furnace before carrying out the hot-rolling refers to an extraction temperature at an outlet side of the heating furnace, and the in-furnace time refers to a time elapsed from an insertion of the slab into the hot heating furnace to an extraction of the slab from the heating furnace. Since the MnS does not change with the hot-rolling or the hot stamping as described above, it is preferable to satisfy the expression g during heating of the slab. The above-described ln represents a natural logarithm.

Next, the hot-rolling is carried out according to a conventional method. At this time, it is desirable to set the finishing temperature (a hot-rolling end temperature) to an Ar3 temperature to 970° C. and carry out the hot-rolling on the slab. When the finishing temperature is less than the Ar3 temperature, there is a concern that the rolling may become a two-phase region rolling of the ferrite (α) and the austenite (γ), and the elongation may degrade. On the other hand, when the finishing temperature is more than 970° C., an austenite grain size coarsens, a fraction of the ferrite becomes small, and there is a concern that the elongation may degrade.

The Ar3 temperature can be estimated from an inflection point after carrying out a formastor test and measuring a change in a length of a test specimen in response to a temperature change.

After the hot-rolling, the steel is cooled at an average cooling rate of 20° C./second to 500° C./second, and is coiled at the predetermined coiling temperature CT° C. In a case in which the cooling rate is less than 20° C./second, the pearlite causing the degradation of the elongation is likely to be formed, which is not preferable.

On the other hand, an upper limit of the cooling rate is not particularly specified, but the upper limit of the cooling rate is desirably set to approximately 500° C./second from a viewpoint of a facility specification, but is not limited thereto.

Figure 4:
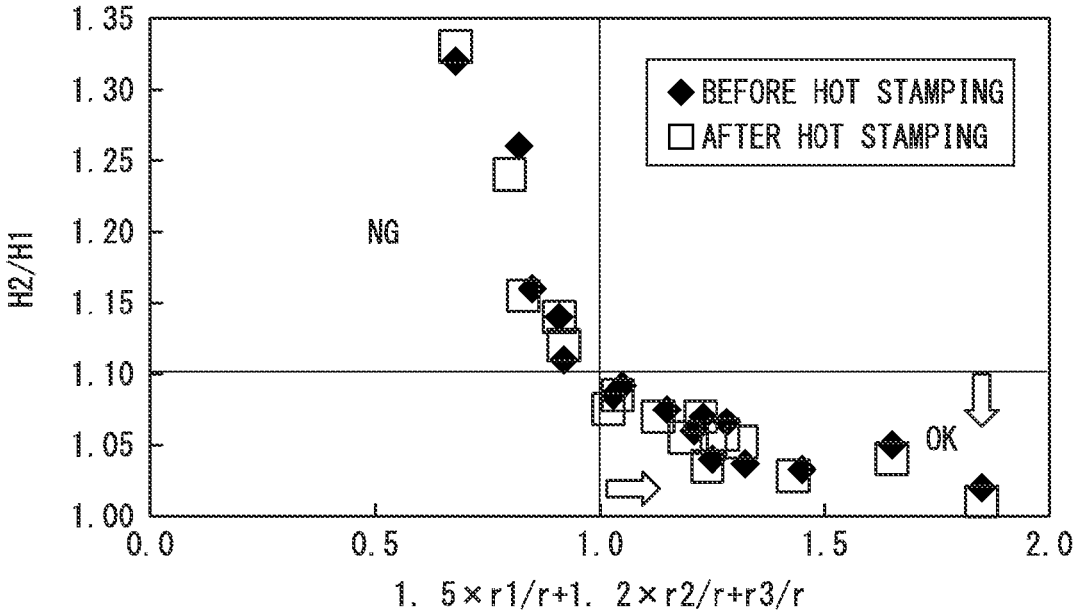
FIG. 4 is a graph illustrating a relationship between 1.5×r1/r+1.2×r2/r+r3/r, and the H2/H1, and illustrating a foundation of an expression e.

After the coiling, pickling is carried out, and cold-rolling is carried out. At this time, as illustrated in FIG. 4, the cold-rolling is carried out under a condition in which the following expression e is satisfied to obtain a range satisfying the above-described expression b. When the above-described rolling is carried out, and then annealing, cooling and the like are performed in below-described conditions, TS×λ>50000 MPa·% can be obtained in the cold rolled steel sheet before hot stamping, and furthermore, it is possible to ensure TS×λ>50000 MPa·% in the hot stamped steel for which the cold rolled steel sheet is used. Meanwhile, the cold-rolling is desirably carried out with a tandem rolling mill in which a plurality of rolling mills is linearly disposed, and the steel sheet is continuously rolled in a single direction, thereby obtaining a predetermined thickness.

$$1.5\times r1/r+1.2\times r2/r+r3/r>1.0 \quad \text{(e)}$$

Here, the "ri (i=1, 2 or 3)" represents an individual target cold-rolling reduction (%) at an $i^{th}$ stand (i=1, 2, 3) based on an uppermost stand in the cold-rolling, and the "r" represents a total target cold-rolling reduction (%) in the cold-rolling.

The total cold-rolling reduction is a so-called cumulative reduction, is based on the sheet thickness at an inlet of a first stand, and is a percentage of the cumulative reduction (a difference between the sheet thickness at the inlet of a first pass and the sheet thickness at an outlet after a final pass) with respect to the above-described basis.

When the cold-rolling is carried out under a condition in which the above-described expression e is satisfied, it is possible to sufficiently divide the pearlite in the cold-rolling even when the large pearlite exists before the cold-rolling. As a result, it is possible to burn the pearlite or suppress the area fraction of the pearlite to the minimum extent through annealing carried out after the cold-rolling. Therefore, it becomes easy to obtain a structure satisfying the expression b and the expression c. On the other hand, in a case in which the expression e is not satisfied, the cold-rolling reductions in the upper stream stands are not sufficient, and the large pearlite is likely to remain. As a result, it is not possible to form the martensite having a desired form in an annealing process.

In addition, the inventors found that, in the cold rolled steel sheet that had been subjected to a rolling satisfying the expression e, it was possible to maintain the form of the martensite structure obtained after the annealing in almost the same state even when the hot stamping is carried out afterwards, and the elongation or the hole expansibility became advantageous. In a case in which the cold rolled steel sheet for hot stamping according to the embodiment is heated up to an austenite region through the hot stamping, the hard phase including the martensite turns into an austenite having a high C concentration, and the ferrite phase turns into the austenite having a low C concentration. When the austenite is cooled afterwards, the austenite forms a hard phase including martensite. That is, when the hot stamping is carried out on the steel sheet for hot stamping having the hardness of the martensite so as to satisfy the expression e (so as to make the above-described H2/H1 in a predetermined range), the above-described H2/H1 reaches in a predetermined range even after the hot stamping, and the formability after the hot stamping becomes excellent.

In the embodiment, the r, the r1, the r2 and the r3 are the target cold-rolling reductions. Generally, the target cold-rolling reduction and an actual cold-rolling reduction are controlled so as to become substantially the same value, and the cold-rolling is carried out. It is not preferable to carry out the target cold-rolling after unnecessarily making the actual cold-rolling reduction different from the cold-rolling reduction. In a case in which there is a large difference between a target rolling reduction and an actual rolling reduction, it is possible to consider that the embodiment is carried out when the actual cold-rolling reduction satisfies the expression e. The actual cold-rolling reduction is preferably converged within ±10% of the cold-rolling reduction.

After the cold-rolling, the annealing is carried out. When the annealing is carried out, a recrystallization is caused in the steel sheet, and the desired martensite is formed. Regarding an annealing temperature, it is preferable to carry out the annealing by heating the steel sheet to a range of 700° C. to 850° C. according to a conventional method, and to cool the steel sheet to 20° C. or a temperature at which a surface treatment such as the hot dip galvanizing is carried out. When the annealing is carried out in the above-described range, it is possible to ensure a desirable fraction of the ferrite and a desirable area fraction of the martensite and to obtain a total of the area fraction of the ferrite and the area fraction of the martensite of 60% or more, TS×λ, improves.

Conditions other than the annealing temperature are not particularly specified, but a lower limit of a holding time at 700° C. to 850° C. is preferably set to 1 second or more to reliably obtain a predetermined structure, for example, approximately 10 minutes as long as the productivity is not impaired. It is preferable to appropriately determine the temperature-increase rate to 1° C./second to an upper limit of a facility capacity, for example, 1000° C./second, and to appropriately determine the cooling rate to 1° C./second to the upper limit of the facility capacity, for example, 500° C./second. Temper-rolling may be carried out with a conventional method. An elongation ratio of the temper-rolling is, generally, approximately 0.2% to 5%, and is preferable when a yield point elongation is avoided and the shape of the steel sheet can be corrected.

As a still more preferable condition of the present invention, when [C] represents the amount of the C (mass %), [Mn] represents the amount of Mn (mass %), [Si] represents the amount of Si (mass %), and [Mo] represents the amount of Mo (mass %) in steel, the coiling temperature CT in a coiling process preferably satisfies the following expression f.

$$560-474\times[C]-90\times[Mn]-20\times[Cr]-20\times[Mo]<CT<830-270\times[C]-90\times[Mn]-70\times[Cr]-80\times[Mo] \quad (f)$$

Figure 5A:
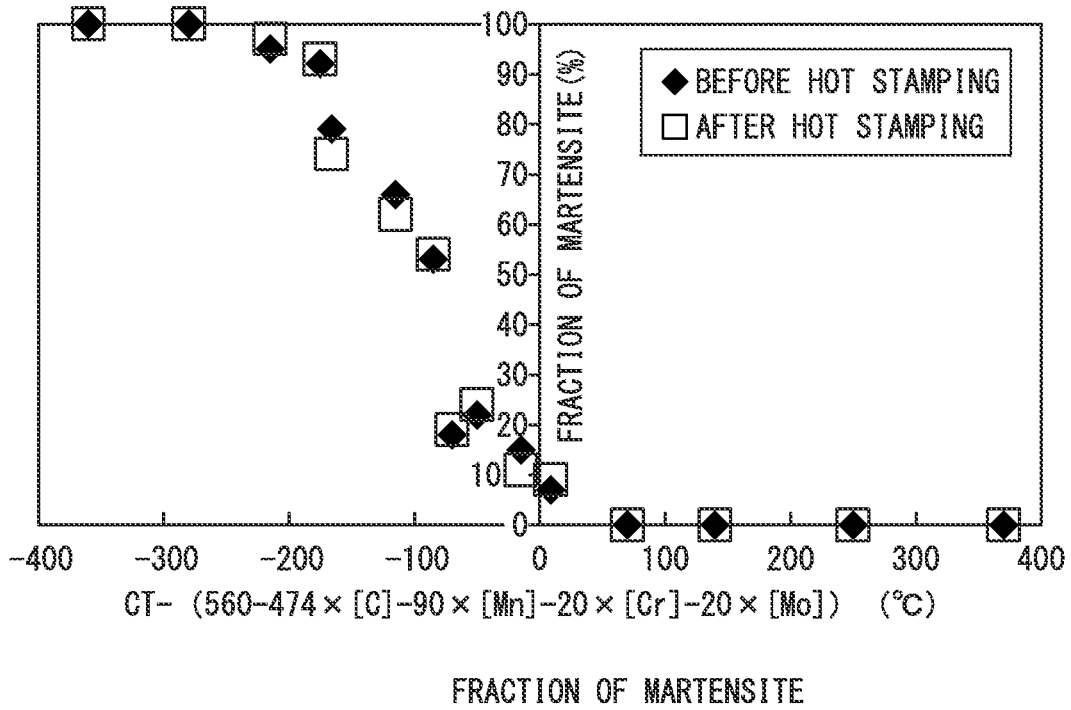
FIG. 5A is a graph illustrating a relationship between an expression f and a fraction of a martensite.
Figure 5B:
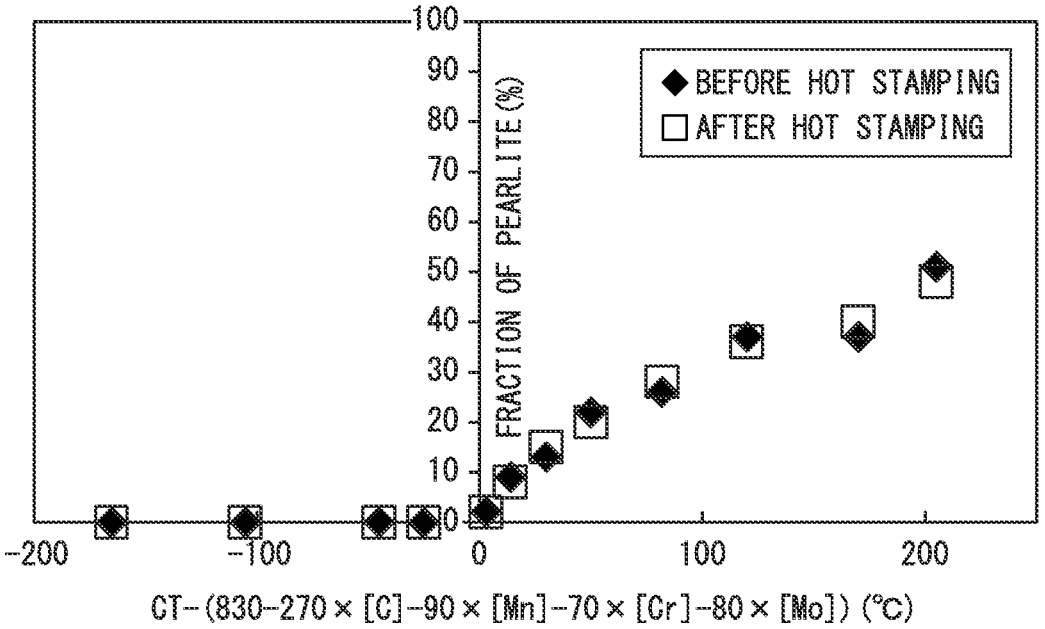
FIG. 5B is a graph illustrating a relationship between the expression f and a fraction of a pearlite.

When the coiling temperature CT is less than 560−474×[C]−90×[Mn]−20×[Cr]−20×[Mo], that is, CT−(560−474×[C]−90×[Mn]−20×[Cr]−20×[Mo]) is less than zero as illustrated in FIG. 5A, the martensite is excessively formed, and the steel sheet becomes too hard such that there is a case in which the subsequent cold-rolling becomes difficult. On the other hand, when the coiling temperature CT is more than 830−270×[C]−90×[Mn]−70×[Cr]−80×[Mo], that is, CT−(830−270×[C]−90×[Mn]−70×[Cr]−80×[Mo]) is more than zero as illustrated in FIG. 5B, a banded structure including the ferrite and the pearlite is likely to be formed. In addition, a fraction of the pearlite in the central part of the sheet thickness is likely to become high. Therefore, a uniformity of a distribution of the martensite being formed in the subsequent annealing process degrades, and it becomes difficult to satisfy the above-described expression b. In addition, there is a case in which it becomes difficult for a sufficient amount of the martensite to be formed.

When the expression f is satisfied, the ferrite and the hard phase have an ideal distribution form before the hot stamping as described above. Furthermore, in this case, the C and the like are likely to diffuse in a uniform manner after heating is carried out in the hot stamping. Therefore, the distribution form of the hardness of the martensite in the hot stamped steel becomes approximately ideal. When it is possible to more reliably ensure the above-described metallographic structure by satisfying the expression f, the formability of the hot stamped steel becomes excellent.

Furthermore, to improve a rust-preventing capability, it is also preferable to include a hot dip galvanizing process in which a hot dip galvanizing is formed between the annealing process and the temper-rolling process and to form the hot dip galvanizing on a surface of the cold rolled steel sheet. Furthermore, it is also preferable to include an alloying process in which an alloying is formed between the hot dip galvanizing process and the temper-rolling process to obtain a galvannealing by alloying the hot dip galvanizing. In a case in which the alloying is carried out, a treatment in which a galvannealed surface is brought into contact with a substance oxidizing a plated surface such as water vapor, thereby thickening an oxidized film may be further carried out on the surface.

It is also preferable to include, for example, an electrogalvanizing process in which an electrogalvanizing is formed on the surface of the cold rolled steel sheet after the temper-rolling process other than the hot dip galvanizing process and the galvannealing process. In addition, it is also preferable to include, instead of the hot dip galvanizing, an aluminizing process in which an aluminizing is formed between the annealing process and the temper-rolling process, and to form the aluminizing on the surface of the cold rolled steel sheet. The aluminizing is generally hot dip aluminizing, which is preferable.

After a series of the above-described treatments, the hot stamping is carried out on the obtained cold rolled steel sheet for hot stamping, thereby producing a hot stamped steel. In a hot stamping process, the hot stamping is desirably carried out under, for example, the following conditions. First, the steel sheet is heated up to 750° C. to 1000° C. at the temperature-increase rate of 5° C./second to 500° C./second.

After the heating, working (forming) is carried out for 1 second to 120 seconds. To obtain a high strength, the heating temperature is preferably more than an Ac3 temperature. The Ac3 temperature was estimated from the inflection point of the length of the test specimen after carrying out the formastor test.

Subsequently, it is preferable to cool the steel sheet to 20° C. to 300° C. at the cooling rate of, for example, 10° C./second to 1000° C./second. When the heating temperature is less than 750° C., in the hot stamped steel, the fraction of the martensite is not sufficient, and the strength cannot be ensured. When the heating temperature is more than 1000° C., the steel sheet becomes too soft, and, in a case in which a plating is formed on the surface of the steel sheet, particularly, in a case in which zinc is plated, there is a concern that the zinc may be evaporated and burned, which is not preferable. Therefore, the heating temperature in the hot stamping process is preferably 750° C. to 1000° C. When the temperature-increase rate is less than 5° C./second, since a control thereof is difficult, and the productivity significantly degrades, it is preferable to heat the steel sheet at the temperature-increase rate of 5° C./second or more. On the other hand, an upper limit of the temperature-increase rate of 500° C./second is from a current heating capability, but is not limited thereto. At the cooling rate of less than 10° C./second, since the rate control thereof is difficult, and the productivity also significantly degrades, it is preferable to cool the steel sheet at the cooling rate of 10° C./second or more. An upper limit of the cooling rate is not particularly specified, but becomes 1000° C./second or less in consideration of a current cooling capability. A reason for carrying out the temperature increasing and the forming working within 1 second to 120 seconds is to avoid the evaporation of the zinc and the like in a case in which the hot dip galvanizing and the like are formed on the surface of the steel sheet. A reason for setting the cooling temperature to 20° C. (the room temperature) to 300° C. is to sufficiently ensure the martensite so as to ensure the strength after the hot stamping.

According to what has been described above, when the above-described conditions are satisfied, it is possible to produce the hot stamped steel in which the hardness distribution or the structure is almost maintained even after the hot stamping, and consequently the strength is ensured and the more favorable hole expansibility can be obtained.

Figure 8:
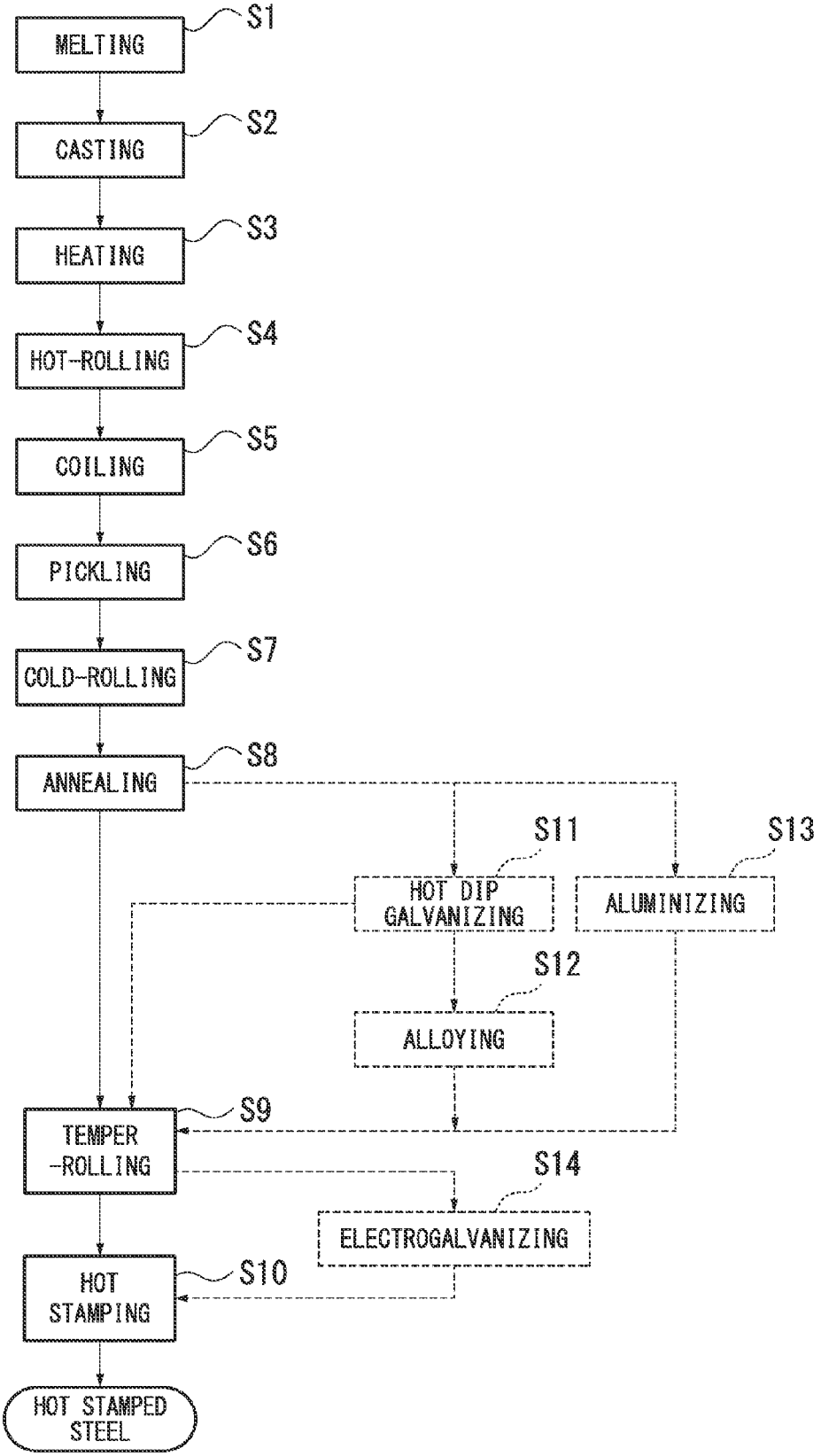
FIG. 8 is a flowchart illustrating a method for producing the hot stamped steel according to an embodiment of the present invention.

FIG. 8 illustrates a flowchart (processes Si to S14) of an example of the production method described above.

EXAMPLE

Figure 7:
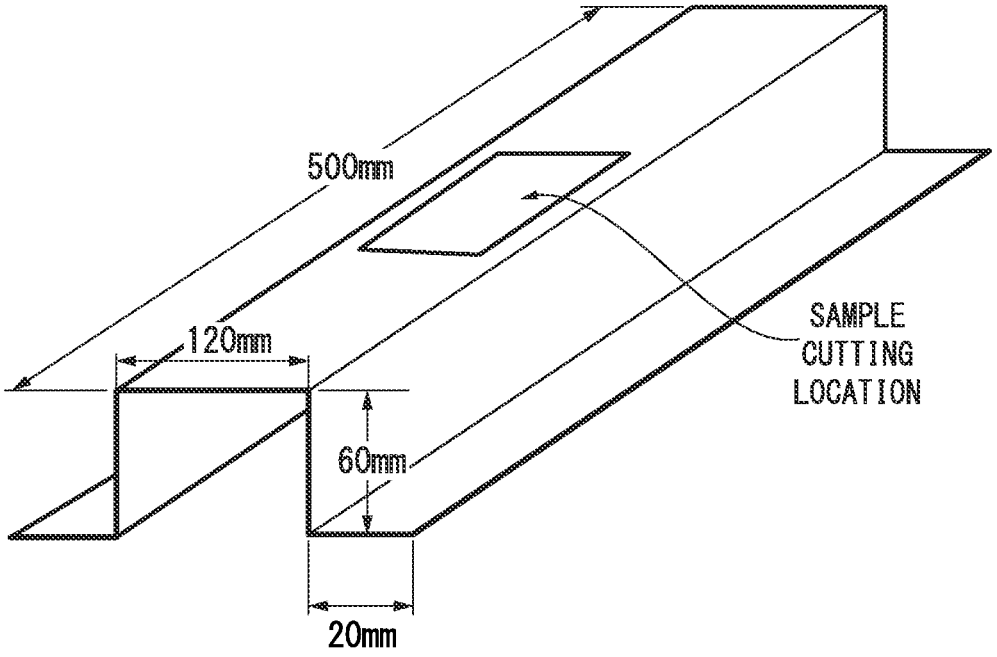
FIG. 7 is a perspective view of a hot stamped steel used in an example.

A steel having a composition described in Table 1 was continuously cast at a casting rate of 1.0 m/minute to 2.5 m/minute, then, a slab was heated in a heating furnace under a condition of Table 2 according to a conventional method as cast or after cooling the steel once, and hot rolling was carried out at a finishing temperature of 910° C. to 930° C., thereby producing a hot rolled steel sheet. After that, the hot rolled steel sheet was coiled at a coiling temperature CT described in Table 2. After that, scales on a surface of the steel sheet were removed by carrying out pickling, and a sheet thickness was set to 1.2 mm to 1.4 mm through cold-rolling. At this time, the cold rolling was carried out so that the value of the expression e became the value described in Table 2. After the cold-rolling, annealing was carried out in a continuous annealing furnace at an annealing temperature described in Tables 3 and 4. On a part of the steel sheets, a hot dip galvanizing was formed in the middle of cooling after soaking in the continuous annealing furnace, and then alloying was further carried out on the part thereof, thereby forming a galvannealing. In addition, an electrogalvanizing or an aluminizing was formed on the part of the steel sheets. Temper rolling was carried out at an elongation ratio of 1% according to a conventional method. In this state, a sample was taken to evaluate material qualities and the like of the cold rolled steel sheet for hot stamping, and a material quality test or the like was carried out. After that, to obtain a hot stamped steel having a form illustrated in FIG. 7, hot stamping in which a temperature was increased at a temperature-increase of 10° C./second, the steel sheet was held at a heating temperature of 850° C. for 10 seconds, and cooled to 200° C. or less at a cooling rate of 100° C./second was carried out. A sample was cut out from a location of FIG. 7 in an obtained molded article, a material quality test and a structure observation were carried out, and fractions of individual structures, a number density of MnS, a hardness, a tensile strength (TS), an elongation (El), a hole expansion ratio (2) and the like were obtained. The results are described in Tables 3 to 8. The hole expansion ratios λ in Tables 3 to 6 are obtained with the following expression i.

$$\lambda(\%)=\{(d'-d)/d\}\times 100 \quad \text{(i)}$$

d': a hole diameter when a crack penetrates a sheet thickness d: an initial hole diameter Regarding plating types in Tables 5 and 6, CR represents a non-plated cold rolled steel sheet, GI represents a formation of the hot dip galvanizing, GA represents a formation of the galvannealing, EG represents a formation of the electrogalvanizing, and Al represents a formation of the aluminizing.

An amount of "0" in Table 1 indicates that an amount is equal to or less than a measurement lower limit.

Determinations G and B in Tables 2, 7 and 8 are defined as follows.

G: a target condition expression is satisfied.

B: the target condition expression is not satisfied.

TABLE 1

(mass %)

| Steel Type Reference symbol | C | Si | Mn | P | S | N | Al | Cr | Mo | V | Ti |
|---|---|---|---|---|---|---|---|---|---|---|---|
| A | 0.151 | 0.145 | 2.01 | 0.003 | 0.008 | 0.0035 | 0.035 | 0 | 0 | 0 | 0 |
| B | 0.158 | 0.231 | 1.61 | 0.023 | 0.006 | 0.0064 | 0.021 | 0 | 0 | 0 | 0 |
| C | 0.167 | 0.950 | 2.12 | 0.008 | 0.009 | 0.0034 | 0.042 | 0.12 | 0 | 0 | 0 |
| D | 0.178 | 0.342 | 1.62 | 0.007 | 0.007 | 0.0035 | 0.042 | 0.42 | 0.15 | 0 | 0 |
| E | 0.186 | 0.251 | 1.89 | 0.008 | 0.008 | 0.0045 | 0.034 | 0.21 | 0 | 0 | 0 |
| F | 0.191 | 0.256 | 1.71 | 0.006 | 0.009 | 0.0087 | 0.041 | 0 | 0 | 0 | 0 |

TABLE 1-continued (mass %)

| | | | | | | | | | | | |
|---|---|---|---|---|---|---|---|---|---|---|---|
| G | 0.197 | 0.321 | 1.51 | 0.012 | 0.008 | 0.0041 | 0.038 | 0 | 0 | 0 | 0 |
| H | 0.206 | 0.465 | 1.52 | 0.051 | 0.001 | 0.0035 | 0.032 | 0.32 | 0.05 | 0 | 0 |
| I | 0.214 | 0.512 | 2.05 | 0.008 | 0.002 | 0.0035 | 0.041 | 0 | 0 | 0.03 | 0 |
| J | 0.216 | 0.785 | 1.62 | 0.007 | 0.009 | 0.0014 | 0.045 | 0 | 0.00 | 0 | 0 |
| K | 0.222 | 0.412 | 1.74 | 0.006 | 0.008 | 0.0026 | 0.034 | 0 | 0 | 0 | 0 |
| L | 0.227 | 0.624 | 2.11 | 0.012 | 0.006 | 0.0015 | 0.012 | 0 | 0.21 | 0 | 0.05 |
| M | 0.231 | 0.325 | 1.58 | 0.011 | 0.005 | 0.0032 | 0.025 | 0 | 0 | 0 | 0 |
| N | 0.236 | 0.265 | 2.61 | 0.009 | 0.008 | 0.0035 | 0.041 | 0 | 0.31 | 0 | 0 |
| O | 0.241 | 0.955 | 1.74 | 0.007 | 0.007 | 0.0041 | 0.037 | 0 | 0.25 | 0 | 0 |
| P | 0.245 | 0.210 | 2.45 | 0.005 | 0.008 | 0.0022 | 0.012 | 0.42 | 0 | 0 | 0 |
| Q | 0.251 | 0.325 | 1.84 | 0.011 | 0.003 | 0.0041 | 0.035 | 0 | 0.11 | 0 | 0 |
| R | 0.256 | 0.120 | 2.06 | 0.008 | 0.004 | 0.0047 | 0.035 | 0 | 0 | 0 | 0 |
| S | 0.264 | 0.562 | 1.86 | 0.013 | 0.007 | 0.0034 | 0.015 | 0 | 0.12 | 0 | 0 |
| T | 0.271 | 0.150 | 2.01 | 0.018 | 0.003 | 0.0031 | 0.031 | 0 | 0.21 | 0 | 0.03 |
| U | 0.278 | 0.115 | 2.41 | 0.011 | 0.003 | 0.0060 | 0.021 | 0 | 0.31 | 0 | 0 |
| W | 0.281 | 0.562 | 2.03 | 0.012 | 0.007 | 0.0012 | 0.036 | 0 | 0 | 0 | 0 |
| X | 0.289 | 0.921 | 1.54 | 0.013 | 0.003 | 0.0087 | 0.026 | 0.15 | 0.11 | 0 | 0.05 |
| Y | 0.293 | 0.150 | 2.44 | 0.009 | 0.007 | 0.0074 | 0.034 | 0.32 | 0 | 0 | 0 |
| Z | 0.298 | 0.352 | 2.00 | 0.008 | 0.004 | 0.0069 | 0.035 | 0 | 0.15 | 0.05 | 0 |
| AA | 0.175 | 0.210 | 1.85 | 0.010 | 0.005 | 0.0025 | 0.025 | 0 | 0 | 0 | 0 |
| AB | 0.185 | 0.210 | 1.84 | 0.011 | 0.005 | 0.0032 | 0.032 | 0 | 0 | 0 | 0 |
| AC | 0.192 | 0.150 | 1.95 | 0.008 | 0.003 | 0.0035 | 0.035 | 0 | 0 | 0 | 0 |
| AD | 0.175 | 0.325 | 1.95 | 0.008 | 0.004 | 0.0034 | 0.031 | 0 | 0.15 | 0 | 0 |
| AE | 0.187 | 0.256 | 1.99 | 0.008 | 0.002 | 0.0030 | 0.031 | 0 | 0 | 0 | 0 |
| AF | 0.192 | 0.263 | 1.85 | 0.008 | 0.002 | 0.0030 | 0.031 | 0 | 0 | 0 | 0 |
| AG | 0.154 | 0.526 | 1.85 | 0.007 | 0.003 | 0.0034 | 0.030 | 0 | 0 | 0 | 0 |
| AH | 0.120 | 0.320 | 1.65 | 0.007 | 0.003 | 0.0035 | 0.035 | 0 | 0 | 0 | 0 |
| AI | 0.321 | 0.489 | 2.04 | 0.003 | 0.006 | 0.0009 | 0.041 | 0 | 0 | 0 | 0 |
| AJ | 0.174 | 0.005 | 2.22 | 0.007 | 0.009 | 0.0035 | 0.035 | 0 | 0.15 | 0 | 0 |
| AK | 0.189 | 1.151 | 1.50 | 0.008 | 0.005 | 0.0034 | 0.026 | 0.280 | 0.32 | 0 | 0 |
| AL | 0.210 | 0.660 | 1.21 | 0.009 | 0.003 | 0.0032 | 0.029 | 0 | 0 | 0 | 0 |
| AM | 0.254 | 0.050 | 2.91 | 0.007 | 0.004 | 0.0034 | 0.036 | 0 | 0 | 0 | 0 |
| AN | 0.263 | 0.321 | 2.05 | 0.091 | 0.003 | 0.0021 | 0.034 | 0.256 | 0.15 | 0 | 0 |
| AO | 0.275 | 0.154 | 2.50 | 0.002 | 0.025 | 0.0059 | 0.034 | 0 | 0 | 0 | 0 |
| AP | 0.245 | 0.256 | 1.52 | 0.011 | 0.009 | 0.0145 | 0.026 | 0 | 0 | 0 | 0 |
| AQ | 0.174 | 0.012 | 2.25 | 0.006 | 0.004 | 0.0058 | 0.003 | 0 | 0.20 | 0 | 0 |
| AR | 0.281 | 0.150 | 2.35 | 0.005 | 0.003 | 0.0035 | 0.074 | 0 | 0.22 | 0 | 0 |
| AS | 0.291 | 0.020 | 1.54 | 0.007 | 0.003 | 0.0032 | 0.031 | 0 | 0 | 0 | 0 |
| AT | 0.294 | 0.315 | 1.95 | 0.005 | 0.003 | 0.0020 | 0.025 | 0 | 0 | 0 | 0 |
| AU | 0.274 | 0.220 | 1.84 | 0.005 | 0.003 | 0.0020 | 0.025 | 0 | 0 | 0 | 0.01 |
| AV | 0.277 | 0.201 | 1.61 | 0.018 | 0.003 | 0.0031 | 0.031 | 0 | 0 | 0 | 0.01 |

| Steel Type Reference symbol | Nb | Ni | Cu | Ca | B | REM | Expression a | Note |
|---|---|---|---|---|---|---|---|---|
| A | 0 | 0 | 0 | 0 | 0 | 0 | 18 | Invention components |
| B | 0 | 0.3 | 0 | 0 | 0 | 0 | 18 | Invention components |
| C | 0 | 0 | 0 | 0 | 0 | 0 | 41 | Invention components |
| D | 0 | 0 | 0 | 0 | 0 | 0 | 19 | Invention components |
| E | 0 | 0 | 0 | 0 | 0 | 0 | 17 | Invention components |
| F | 0 | 0 | 0.4 | 0.004 | 0 | 0 | 16 | Invention components |
| G | 0 | 0 | 0 | 0 | 0 | 0 | 16 | Invention components |
| H | 0 | 0 | 0 | 0.003 | 0 | 0 | 19 | Invention components |
| I | 0 | 0 | 0 | 0 | 0 | 0 | 22 | Invention components |
| J | 0 | 0 | 0 | 0 | 0.0008 | 0 | 26 | Invention components |
| K | 0 | 0 | 0 | 0 | 0 | 0 | 18 | Invention components |
| L | 0 | 0 | 0 | 0 | 0 | 0 | 24 | Invention components |
| M | 0 | 0 | 0 | 0 | 0 | 0 | 14 | Invention components |
| N | 0 | 0 | 0 | 0 | 0.0012 | 0 | 17 | Invention components |
| O | 0 | 0 | 0 | 0 | 0 | 0 | 28 | Invention components |
| P | 0 | 0 | 0 | 0 | 0 | 0 | 15 | Invention components |
| Q | 0.01 | 0 | 0 | 0 | 0.0010 | 0 | 14 | Invention components |
| R | 0.03 | 0 | 0 | 0 | 0 | 0 | 11 | Invention components |
| S | 0 | 0 | 0 | 0 | 0 | 0 | 18 | Invention components |
| T | 0 | 0 | 0 | 0 | 0 | 0 | 10 | Invention components |
| U | 0 | 0 | 0 | 0 | 0.0008 | 0 | 11 | Invention components |
| W | 0 | 0 | 0 | 0.002 | 0 | 0 | 17 | Invention components |
| X | 0 | 0 | 0 | 0 | 0.0014 | 0.0005 | 22 | Invention components |
| Y | 0 | 0 | 0 | 0 | 0.0015 | 0 | 11 | Invention components |
| Z | 0 | 0 | 0 | 0 | 0 | 0 | 13 | Invention components |
| AA | 0 | 0 | 0 | 0 | 0 | 0 | 17 | Invention components |
| AB | 0 | 0 | 0 | 0 | 0.0008 | 0 | 16 | Invention components |
| AC | 0 | 0 | 0 | 0 | 0.0011 | 0 | 14 | Invention components |
| AD | 0 | 0 | 0 | 0 | 0 | 0 | 20 | Invention components |
| AE | 0.01 | 0 | 0 | 0 | 0.0015 | 0 | 17 | Invention components |
| AF | 0 | 0 | 0 | 0 | 0 | 0 | 16 | Invention components |

TABLE 1-continued

| | | | | | | | | |
|---|---|---|---|---|---|---|---|---|
| | | | | (mass %) | | | | |
| AG | 0 | 0 | 0 | 0 | 0 | 0 | 29 | Invention components |
| AH | 0 | 0 | 0 | 0 | 0 | 0.0006 | 27 | Comparative components |
| AI | 0 | 0 | 0 | 0 | 0 | 0 | 14 | Comparative components |
| AJ | 0 | 0 | 0 | 0 | 0.0012 | 0 | 13 | Comparative components |
| AK | 0 | 0 | 0 | 0 | 0.0015 | 0 | 38 | Comparative components |
| AL | 0 | 0 | 0 | 0 | 0.0000 | 0 | 21 | Comparative components |
| AM | 0 | 0 | 0 | 0 | 0 | 0 | 12 | Comparative components |
| AN | 0.03 | 0 | 0 | 0 | 0 | 0 | 14 | Comparative components |
| AO | 0 | 0.2 | 0 | 0 | 0 | 0 | 12 | Comparative components |
| AP | 0.02 | 0 | 0 | 0.003 | 0 | 0 | 11 | Comparative components |
| AQ | 0 | 0 | 0 | 0 | 0 | 0 | 13 | Comparative components |
| AR | 0 | 0 | 0 | 0 | 0 | 0 | 11 | Comparative components |
| AS | 0 | 0 | 0 | 0 | 0.001 | 0 | 6 | Comparative components |
| AT | 0.01 | 0 | 0 | 0 | 0 | 0 | 12 | Invention components |
| AU | 0 | 0 | 0 | 0 | 0 | 0 | 11 | Invention components |
| AV | 0 | 0 | 0 | 0 | 0 | 0 | 9 | Comparative components |

TABLE 2

| Test reference symbol | Heating furnace temperature (° C.) | Heating furnace in-furnace time (minutes) | Right side of expression (g) | Determination | Left side of expression (e) | Determination | Left side of expression (f) | CT (° C.) | Right side of expression (f) | Determination |
|---|---|---|---|---|---|---|---|---|---|---|
| 1 | 1200 | 121 | 1616 | G | 1.4 | G | 308 | 550 | 608 | G |
| 2 | 1111 | 39 | 1371 | B | 1.2 | G | 340 | 615 | 642 | G |
| 3 | 1285 | 205 | 1502 | G | 1.1 | G | 288 | 555 | 586 | G |
| 4 | 1156 | 124 | 1800 | G | 1.4 | G | 318 | 495 | 595 | G |
| 5 | 1222 | 136 | 1733 | G | 1.4 | G | 298 | 574 | 595 | G |
| 6 | 1232 | 127 | 1887 | G | 1.2 | G | 316 | 631 | 625 | B |
| 7 | 1256 | 111 | 2048 | G | 1.3 | G | 331 | 623 | 641 | G |
| 8 | 1256 | 106 | 1921 | G | 1.2 | G | 318 | 601 | 611 | G |
| 9 | 1250 | 205 | 1665 | G | 1.6 | G | 278 | 554 | 590 | G |
| 10 | 1206 | 87 | 1522 | G | 1.4 | G | 313 | 440 | 626 | G |
| 11 | 1214 | 152 | 1810 | G | 1.1 | G | 301 | 627 | 615 | B |
| 12 | 1233 | 182 | 1524 | G | 1.2 | 5 | 261 | 550 | 563 | G |
| 13 | 1198 | 132 | 1943 | G | 1.3 | G | 310 | 457 | 627 | G |
| 14 | 1287 | 252 | 1513 | G | 1.2 | G | 209 | 389 | 508 | G |
| 15 | 1105 | 201 | 1498 | B | 1.5 | G | 287 | 541 | 590 | G |
| 16 | 1285 | 222 | 1587 | G | 1.7 | G | 217 | 487 | 515 | G |
| 17 | 1156 | 135 | 1642 | G | 1.9 | G | 276 | 501 | 589 | G |
| 18 | 1200 | 185 | 1730 | G | 1.6 | G | 256 | 244 | 577 | B |
| 19 | 1232 | 122 | 1589 | G | 1.3 | G | 269 | 520 | 584 | G |
| 20 | 1256 | 152 | 1769 | G | 1.1 | G | 250 | 512 | 561 | G |
| 21 | 1256 | 155 | 1506 | G | 1.2 | G | 209 | 489 | 515 | G |
| 22 | 1250 | 145 | 1550 | G | 1.3 | G | 246 | 501 | 572 | G |
| 23 | 1150 | 138 | 1600 | G | 1.2 | G | 283 | 253 | 596 | B |
| 24 | 1260 | 182 | 1526 | G | 1.4 | G | 197 | 485 | 510 | G |
| 25 | 1146 | 114 | 1447 | B | 1.5 | G | 236 | 504 | 558 | G |
| 26 | 1200 | 132 | 1746 | G | 0.7 | B | 311 | 602 | 616 | G |
| 27 | 1194 | 71 | 1525 | G | 0.8 | B | 307 | 514 | 614 | G |
| 28 | 1163 | 96 | 1532 | G | 0.6 | B | 293 | 506 | 603 | G |
| 29 | 1200 | 145 | 1641 | G | 0.8 | B | 299 | 451 | 595 | G |
| 30 | 1155 | 152 | 1595 | G | 0.9 | B | 292 | 554 | 600 | G |
| 31 | 1187 | 75 | 1504 | G | 0.7 | B | 302 | 521 | 612 | G |
| 32 | 1215 | 152 | 1663 | G | 0.8 | B | 321 | 555 | 622 | G |
| 33 | 1241 | 132 | 1939 | G | 1.2 | G | 355 | 511 | 649 | G |
| 34 | 1250 | 178 | 1637 | G | 1.1 | G | 224 | 545 | 560 | G |
| 35 | 1205 | 111 | 1502 | G | 1.2 | G | 275 | 520 | 571 | G |
| 36 | 1156 | 127 | 1513 | G | 1.2 | G | 323 | 510 | 599 | G |
| 37 | 1109 | 45 | 1554 | G | 1.2 | G | 352 | 602 | 664 | G |
| 38 | 1295 | 336 | 1508 | G | 1.3 | G | 178 | 485 | 500 | G |
| 39 | 1212 | 124 | 1535 | G | 1.2 | G | 243 | 540 | 544 | G |
| 40 | 1297 | 164 | 1504 | G | 1.3 | G | 202 | 501 | 521 | G |
| 41 | 1312 | 132 | 2256 | G | 1.1 | G | 307 | 582 | 627 | G |
| 42 | 1241 | 162 | 1645 | G | 1.1 | G | 271 | 389 | 565 | G |
| 43 | 1254 | 222 | 1634 | G | 1.5 | G | 211 | 471 | 525 | G |
| 45 | 1278 | 205 | 2579 | G | 1.4 | G | 283 | 600 | 613 | G |
| 46 | 1199 | 210 | 1766 | G | 1.3 | G | 245 | 502 | 575 | G |
| 47 | 1185 | 202 | 1879 | G | 1.6 | G | 265 | 552 | 590 | G |
| 48 | 1194 | 202 | 2157 | G | 1.6 | G | 284 | 502 | 610 | G |

TABLE 3

| Steel type reference symbol | Test reference symbol | Annealing condition Annealing temperature (° C.) | After annealing and temper rolling and before hot stamping (cold rolled steel sheet for hot stamping) TS (MPa) | EL (%) | λ (%) | TS × EL (MPa · %) | TS × λ (MPa · %) | Ferrite area fraction (%) | Martensite area fraction (%) | Ferrite + martensite area fraction (%) | Retained austenite area fraction (%) | Bainite area fraction (%) | Pearlite area fraction (%) | Pearlite area fraction before cold rolling (%) |
|---|---|---|---|---|---|---|---|---|---|---|---|---|---|---|
| A | 1 | 774 | 584 | 32.5 | 111 | 18980 | 64824 | 88 | 11 | 99 | 1 | 0 | 0 | 31 |
| B | 2 | 778 | 578 | 28.5 | 100 | 16473 | 57800 | 74 | 15 | 89 | 3 | 4 | 4 | 25 |
| C | 3 | 784 | 524 | 30.5 | 99 | 15982 | 51876 | 75 | 12 | 87 | 4 | 5 | 4 | 32 |
| D | 4 | 825 | 562 | 33.2 | 95 | 18658 | 53390 | 77 | 12 | 89 | 3 | 8 | 0 | 24 |
| E | 5 | 815 | 591 | 29.8 | 90 | 17612 | 53190 | 70 | 15 | 85 | 4 | 11 | 0 | 51 |
| F | 6 | 780 | 622 | 27.4 | 81 | 17043 | 50382 | 58 | 10 | 68 | 3 | 20 | 9 | 62 |
| G | 7 | 841 | 603 | 31.2 | 83 | 18814 | 50049 | 74 | 12 | 86 | 2 | 6 | 6 | 48 |
| H | 8 | 784 | 612 | 30.5 | 85 | 18666 | 52020 | 70 | 15 | 85 | 3 | 8 | 4 | 35 |
| I | 9 | 778 | 614 | 28.1 | 82 | 17253 | 50348 | 75 | 12 | 87 | 4 | 5 | 4 | 71 |
| J | 10 | 825 | 665 | 30.5 | 76 | 20283 | 50540 | 76 | 12 | 88 | 3 | 7 | 2 | 25 |
| K | 11 | 841 | 709 | 23.1 | 71 | 16378 | 50339 | 61 | 10 | 71 | 4 | 17 | 8 | 35 |
| L | 12 | 815 | 705 | 25.6 | 72 | 18048 | 50760 | 79 | 12 | 91 | 2 | 5 | 2 | 15 |
| M | 13 | 805 | 712 | 24.2 | 80 | 17230 | 56960 | 66 | 26 | 92 | 3 | 5 | 0 | 10 |
| N | 14 | 789 | 755 | 28.6 | 81 | 21593 | 61155 | 50 | 34 | 84 | 2 | 5 | 9 | 42 |
| O | 15 | 785 | 762 | 29.8 | 74 | 22708 | 56388 | 72 | 19 | 91 | 3 | 6 | 0 | 9 |
| P | 16 | 785 | 748 | 25.5 | 68 | 19074 | 50864 | 59 | 28 | 87 | 3 | 1 | 9 | 25 |
| Q | 17 | 841 | 780 | 20.1 | 71 | 15678 | 55380 | 78 | 18 | 96 | 0 | 4 | 0 | 31 |
| R | 18 | 845 | 783 | 20.1 | 65 | 15738 | 50895 | 41 | 44 | 85 | 4 | 5 | 6 | 51 |
| S | 19 | 789 | 805 | 20.4 | 74 | 16422 | 59570 | 42 | 38 | 80 | 4 | 10 | 6 | 46 |
| T | 20 | 785 | 789 | 22.2 | 71 | 17516 | 56019 | 44 | 40 | 84 | 3 | 12 | 1 | 18 |
| U | 21 | 805 | 845 | 20.2 | 62 | 17069 | 52390 | 41 | 38 | 79 | 5 | 12 | 4 | 22 |
| W | 22 | 778 | 922 | 17.4 | 61 | 16043 | 56242 | 41 | 39 | 80 | 4 | 12 | 4 | 15 |
| X | 23 | 804 | 988 | 15.5 | 51 | 15314 | 50388 | 42 | 46 | 88 | 2 | 4 | 6 | 45 |
| Y | 24 | 820 | 1012 | 17.4 | 51 | 17609 | 51612 | 45 | 37 | 82 | 2 | 16 | 0 | 42 |
| Z | 25 | 836 | 1252 | 13.5 | 45 | 16902 | 56340 | 41 | 48 | 89 | 2 | 9 | 0 | 10 |

TABLE 4

| Steel type reference symbol | Test reference symbol | Annealing condition Annealing temperature (° C.) | After annealing and temper rolling and before hot stamping (cold rolled steel sheet for hot stamping) TS (MPa) | EL (%) | λ (%) | TS × EL (MPa · %) | TS × λ (MPa · %) | Ferrite area fraction (%) | Martensite area fraction (%) | Ferrite + martensite area fraction (%) | Retained austenite area fraction (%) | Bainite area fraction (%) | Pearlite area fraction (%) | Pearlite area fraction before cold rolling (%) |
|---|---|---|---|---|---|---|---|---|---|---|---|---|---|---|
| AA | 26 | 804 | 577 | 27.2 | 77 | 15694 | 44429 | 59 | 10 | 69 | 2 | 12 | 17 | 35 |
| AB | 27 | 775 | 601 | 26.8 | 69 | 16107 | 41469 | 64 | 15 | 79 | 0 | 6 | 15 | 32 |
| AC | 28 | 754 | 513 | 28.9 | 74 | 14826 | 37962 | 62 | 12 | 74 | 2 | 5 | 19 | 25 |
| AD | 29 | 778 | 588 | 23.1 | 72 | 13583 | 42336 | 36 | 15 | 51 | 1 | 45 | 3 | 5 |
| AE | 30 | 780 | 595 | 27.9 | 69 | 16601 | 41055 | 73 | 10 | 83 | 2 | 3 | 12 | 66 |
| AF | 31 | 805 | 616 | 28.5 | 64 | 17556 | 39424 | 70 | 9 | 79 | 2 | 10 | 9 | 22 |
| AG | 32 | 812 | 632 | 28.6 | 52 | 18075 | 32864 | 58 | 20 | 78 | 2 | 9 | 11 | 25 |
| AH | 33 | 768 | 326 | 41.9 | 112 | 13659 | 36512 | 95 | 0 | 95 | 3 | 2 | 0 | 2 |
| AI | 34 | 781 | 1512 | 8.9 | 25 | 13457 | 37800 | 5 | 90 | 95 | 4 | 1 | 0 | 3 |
| AJ | 35 | 805 | 635 | 22.5 | 72 | 14288 | 45720 | 74 | 22 | 96 | 2 | 2 | 0 | 42 |
| AK | 36 | 789 | 625 | 31.2 | 55 | 19500 | 34375 | 75 | 22 | 97 | 2 | 1 | 0 | 15 |
| AL | 37 | 784 | 705 | 26.0 | 48 | 18330 | 33840 | 42 | 25 | 67 | 1 | 25 | 7 | 2 |
| AM | 38 | 841 | 795 | 15.6 | 36 | 12402 | 28620 | 30 | 52 | 82 | 3 | 10 | 5 | 14 |
| AN | 39 | 845 | 784 | 19.1 | 42 | 14974 | 32928 | 51 | 37 | 88 | 3 | 9 | 0 | 16 |
| AO | 40 | 826 | 602 | 30.5 | 35 | 18361 | 21070 | 68 | 21 | 89 | 4 | 7 | 0 | 22 |
| AP | 41 | 807 | 586 | 27.4 | 66 | 16056 | 38676 | 69 | 21 | 90 | 4 | 6 | 0 | 32 |
| AQ | 42 | 845 | 1254 | 7.5 | 25 | 9405 | 31350 | 11 | 68 | 79 | 4 | 11 | 6 | 22 |
| AR | 43 | 775 | 1480 | 9.6 | 26 | 14208 | 38480 | 12 | 69 | 81 | 3 | 16 | 0 | 5 |
| AS | 45 | 845 | 1152 | 12.0 | 42 | 13824 | 48384 | 41 | 35 | 76 | 0 | 23 | 1 | 5 |
| AT | 46 | 684 | 852 | 16.0 | 52 | 13632 | 44304 | 80 | 0 | 80 | 1 | 2 | 17 | 5 |
| AU | 47 | 912 | 1355 | 6.0 | 33 | 8130 | 44715 | 5 | 50 | 55 | 1 | 40 | 4 | 5 |
| AV | 48 | 805 | 1355 | 6.0 | 33 | 8130 | 44715 | 41 | 48 | 89 | 1 | 10 | 0 | 5 |

TABLE 5

| Test reference symbol | Hot stamping condition Thermal treatment temperature (° C.) | After hot stamping(hot stamped steel) TS (MPa) | EL (%) | λ (%) | TS × EL (MPa · %) | TS × λ (MPa · %) | Ferrite area fraction (%) | Martensite area fraction (%) | Ferrite + martensite area fraction (%) | Retained austenite area fraction (%) | Bainite area fraction (%) | Pearlite area fraction (%) | Plating type *) | Note |
|---|---|---|---|---|---|---|---|---|---|---|---|---|---|---|
| 1 | 871 | 1512 | 8.5 | 41 | 12852 | 61992 | 10 | 82 | 92 | 1 | 7 | 0 | CR | Invention example |
| 2 | 861 | 1514 | 7.6 | 38 | 11506 | 57532 | 12 | 84 | 96 | 0 | 4 | 0 | GA | Invention example |
| 3 | 825 | 1612 | 8.1 | 37 | 13057 | 59644 | 8 | 81 | 89 | 1 | 5 | 5 | GI | Invention example |
| 4 | 816 | 1658 | 7.4 | 40 | 12269 | 66320 | 11 | 86 | 97 | 3 | 0 | 0 | EG | Invention example |
| 5 | 901 | 1689 | 8.4 | 36 | 14188 | 60804 | 9 | 84 | 93 | 1 | 0 | 6 | AI | Invention example |
| 6 | 778 | 1745 | 8.2 | 37 | 14309 | 64565 | 10 | 82 | 92 | 3 | 5 | 0 | CR | Invention example |
| 7 | 885 | 1784 | 7.6 | 38 | 13558 | 67792 | 5 | 81 | 86 | 0 | 6 | 8 | CR | Invention example |
| 8 | 925 | 1795 | 9.2 | 40 | 16514 | 71800 | 0 | 89 | 89 | 3 | 8 | 0 | GA | Invention example |
| 9 | 955 | 1812 | 8.6 | 35 | 15583 | 63420 | 0 | 94 | 94 | 0 | 6 | 0 | GA | Invention example |
| 10 | 875 | 1815 | 9.1 | 34 | 16517 | 61710 | 0 | 100 | 100 | 0 | 0 | 0 | GA | Invention example |
| 11 | 851 | 1823 | 8.4 | 31 | 15313 | 56513 | 0 | 100 | 100 | 0 | 0 | 0 | GA | Invention example |
| 12 | 864 | 1855 | 8.2 | 36 | 15211 | 66780 | 0 | 97 | 97 | 2 | 0 | 1 | GI | Invention example |
| 13 | 865 | 1894 | 7.6 | 37 | 14394 | 70078 | 0 | 100 | 100 | 0 | 0 | 0 | GA | Invention example |
| 14 | 897 | 1912 | 9.2 | 35 | 17590 | 66920 | 5 | 90 | 95 | 0 | 5 | 0 | GA | Invention example |
| 15 | 880 | 1894 | 8.6 | 36 | 16288 | 68184 | 0 | 100 | 100 | 0 | 0 | 0 | GI | Invention example |
| 16 | 888 | 1912 | 8.4 | 37 | 16061 | 70744 | 0 | 94 | 94 | 0 | 6 | 0 | GA | Invention example |
| 17 | 955 | 1925 | 8.2 | 38 | 15785 | 73150 | 3 | 92 | 95 | 3 | 2 | 0 | GA | Invention example |
| 18 | 856 | 1945 | 7.6 | 40 | 14782 | 77800 | 0 | 100 | 100 | 0 | 0 | 0 | CR | Invention example |
| 19 | 841 | 1962 | 9.2 | 35 | 18050 | 68670 | 0 | 94 | 94 | 0 | 0 | 6 | GA | Invention example |
| 20 | 874 | 2012 | 8.6 | 34 | 17303 | 68408 | 0 | 100 | 100 | 0 | 0 | 0 | GI | Invention example |
| 21 | 884 | 2015 | 9.1 | 31 | 18337 | 62465 | 4 | 95 | 99 | 0 | 0 | 1 | EG | Invention example |
| 22 | 908 | 2025 | 7.8 | 36 | 15795 | 72900 | 0 | 100 | 100 | 0 | 0 | 0 | GA | Invention example |
| 23 | 925 | 2035 | 8.6 | 37 | 17501 | 75295 | 10 | 90 | 100 | 0 | 0 | 0 | AI | Invention example |
| 24 | 901 | 2145 | 8.7 | 35 | 18662 | 75075 | 0 | 87 | 87 | 1 | 10 | 2 | GA | Invention example |
| 25 | 865 | 2215 | 8.2 | 40 | 18163 | 88600 | 0 | 100 | 100 | 0 | 0 | 0 | CR | Invention example |

TABLE 6

| Test reference symbol | Hot stamping condition Thermal treatment temperature (° C.) | After hot stamping(hot stamped steel) TS (MPa) | EL (%) | λ (%) | TS × EL (MPa · %) | TS × λ (MPa · %) | Ferrite area fraction (%) | Martensite area fraction (%) | Ferrite + martensite area fraction (%) | Retained austenite area fraction (%) | Bainite area fraction (%) | Pearlite area fraction (%) | Plating type *) | Note |
|---|---|---|---|---|---|---|---|---|---|---|---|---|---|---|
| 26 | 849 | 1754 | 20.1 | 26 | 35255 | 45604 | 8 | 77 | 85 | 0 | 5 | 10 | GA | Comparative example |
| 27 | 878 | 1792 | 16.1 | 26 | 28851 | 46592 | 5 | 74 | 79 | 0 | 12 | 9 | CR | Comparative example |
| 28 | 865 | 1817 | 15.4 | 26 | 27982 | 47242 | 3 | 81 | 84 | 0 | 3 | 13 | GA | Comparative example |
| 29 | 825 | 1823 | 16.5 | 27 | 30080 | 49221 | 8 | 76 | 84 | 3 | 11 | 2 | EG | Comparative example |
| 30 | 869 | 1988 | 14.9 | 25 | 29621 | 49700 | 6 | 78 | 84 | 0 | 7 | 9 | GI | Comparative example |
| 31 | 848 | 1965 | 13.6 | 25 | 26724 | 49125 | 8 | 77 | 85 | 0 | 11 | 4 | AI | Comparative example |
| 32 | 876 | 1512 | 18.5 | 25 | 27972 | 37800 | 7 | 74 | 81 | 4 | 7 | 8 | CR | Comparative example |
| 33 | 835 | 1524 | 42.5 | 24 | 64770 | 36576 | 32 | 52 | 84 | 10 | 2 | 4 | GA | Comparative example |
| 34 | 895 | 2012 | 8.5 | 21 | 17102 | 42252 | 30 | 62 | 92 | 4 | 1 | 3 | GA | Comparative example |
| 35 | 888 | 1812 | 18.5 | 26 | 33522 | 47112 | 5 | 85 | 90 | 2 | 5 | 3 | GA | Comparative example |
| 36 | 846 | 1842 | 17.2 | 20 | 31682 | 36840 | 0 | 95 | 95 | 2 | 3 | 0 | GA | Comparative example |
| 37 | 805 | 1785 | 16.5 | 25 | 29453 | 44625 | 7 | 78 | 85 | 3 | 10 | 2 | GI | Comparative example |
| 38 | 863 | 1812 | 15.0 | 26 | 27180 | 47112 | 3 | 92 | 95 | 3 | 2 | 0 | GI | Comparative example |
| 39 | 878 | 1845 | 18.2 | 24 | 33579 | 44280 | 0 | 100 | 100 | 0 | 0 | 0 | GI | Comparative example |
| 40 | 899 | 2012 | 17.0 | 21 | 34204 | 42252 | 0 | 95 | 95 | 0 | 0 | 5 | GI | Comparative example |
| 41 | 905 | 1744 | 31.0 | 22 | 54064 | 38368 | 0 | 100 | 100 | 0 | 0 | 0 | EG | Comparative example |
| 42 | 923 | 2012 | 11.1 | 21 | 22333 | 42252 | 11 | 68 | 79 | 4 | 11 | 6 | AI | Comparative example |
| 43 | 907 | 2022 | 10.2 | 21 | 20624 | 42462 | 12 | 69 | 81 | 3 | 16 | 0 | GA | Comparative example |
| 45 | 845 | 2014 | 10.0 | 20 | 20140 | 40280 | 4 | 78 | 82 | 3 | 13 | 2 | GA | Comparative example |
| 46 | 879 | 2033 | 13.0 | 21 | 26429 | 42693 | 4 | 72 | 76 | 0 | 22 | 2 | GA | Comparative example |
| 47 | 886 | 2122 | 9.0 | 20 | 19098 | 42440 | 19 | 55 | 74 | 3 | 14 | 9 | GA | Comparative example |
| 48 | 914 | 2066 | 11.0 | 24 | 22726 | 49584 | 7 | 86 | 93 | 0 | 5 | 2 | GA | Comparative example |

TABLE 7

| Steel type reference symbol | Test reference symbol | Cold rolled steel sheet for hot stamping: Left side of expression (b) | Determination | Hot Stamped steel: Left side of expression (b) | Determination | Cold rolled steel sheet for hot stamping: Left side of expression (c) | Determination | Hot Stamped steel: Left side of expression (c) | Determination | Cold rolled steel sheet for hot stamping Area: fraction of MnS of 0.1 μm or more (%) |
|---|---|---|---|---|---|---|---|---|---|---|
| A | 1 | 1.02 | G | 1.02 | G | 15 | G | 16 | G | 0.005 |
| B | 2 | 1.03 | G | 1.03 | G | 18 | G | 17 | G | 0.011 |
| C | 3 | 1.04 | G | 1.04 | G | 12 | G | 10 | G | 0.005 |
| D | 4 | 1.01 | G | 1.01 | G | 14 | G | 18 | G | 0.006 |
| E | 5 | 1.06 | G | 1.06 | G | 11 | G | 14 | G | 0.007 |
| F | 6 | 1.06 | G | 1.06 | G | 10 | G | 10 | G | 0.008 |
| G | 7 | 1.06 | G | 1.06 | G | 11 | G | 10 | G | 0.004 |
| H | 8 | 1.03 | G | 1.03 | G | 16 | G | 17 | G | 0.008 |
| I | 9 | 1.07 | G | 1.07 | G | 18 | G | 16 | G | 0.006 |
| J | 10 | 1.08 | G | 1.08 | G | 10 | G | 11 | G | 0.007 |
| K | 11 | 1.09 | G | 1.09 | G | 6 | G | 6 | G | 0.006 |
| L | 12 | 1.08 | G | 1.08 | G | 6 | G | 8 | G | 0.008 |
| M | 13 | 1.06 | G | 1.06 | G | 8 | G | 7 | G | 0.009 |
| N | 14 | 1.07 | G | 1.07 | G | 13 | G | 14 | G | 0.003 |
| O | 15 | 1.06 | G | 1.06 | G | 3 | G | 5 | G | 0.011 |
| P | 16 | 1.08 | G | 1.08 | G | 18 | G | 17 | G | 0.007 |
| Q | 17 | 1.06 | G | 1.06 | G | 14 | G | 13 | G | 0.006 |
| R | 18 | 1.04 | G | 1.04 | G | 13 | G | 13 | G | 0.008 |
| S | 19 | 1.02 | G | 1.02 | G | 9 | G | 8 | G | 0.003 |
| T | 20 | 1.03 | G | 1.03 | G | 8 | G | 8 | G | 0.008 |
| U | 21 | 1.03 | G | 1.03 | G | 8 | G | 6 | G | 0.005 |
| W | 22 | 1.05 | G | 1.05 | G | 11 | G | 10 | G | 0.006 |
| X | 23 | 1.07 | G | 1.07 | G | 16 | G | 16 | G | 0.007 |
| Y | 24 | 1.06 | G | 1.06 | G | 16 | G | 17 | G | 0.006 |
| Z | 25 | 1.04 | G | 1.04 | G | 15 | G | 17 | G | 0.012 |

| Steel type reference symbol | Test reference symbol | Hot Stamped steel Area: fraction of MnS of 0.1 μm or more (%) | Cold rolled steel sheet for hot stamping: n1 | n2 | Left side of expression (d) | Determination | Hot Stamped steel: n1 | n2 | Left side of expression (d) | Determination |
|---|---|---|---|---|---|---|---|---|---|---|
| A | 1 | 0.005 | 10 | 12 | 1.2 | G | 9 | 12 | 1.3 | G |
| B | 2 | 0.011 | 7 | 12 | 1.7 | B | 8 | 12 | 1.5 | B |
| C | 3 | 0.007 | 5 | 7 | 1.4 | G | 5 | 6 | 1.2 | G |
| D | 4 | 0.006 | 9 | 11 | 1.2 | G | 9 | 10 | 1.1 | G |
| E | 5 | 0.008 | 17 | 18 | 1.1 | G | 18 | 19 | 1.1 | G |
| F | 6 | 0.003 | 14 | 16 | 1.1 | G | 12 | 15 | 1.3 | G |
| G | 7 | 0.008 | 7 | 10 | 1.4 | G | 7 | 10 | 1.4 | G |
| H | 8 | 0.005 | 9 | 10 | 1.1 | G | 9 | 10 | 1.1 | G |
| I | 9 | 0.006 | 19 | 20 | 1.1 | G | 20 | 21 | 1.1 | G |
| J | 10 | 0.007 | 26 | 29 | 1.1 | G | 25 | 26 | 1.0 | G |
| K | 11 | 0.006 | 7 | 8 | 1.1 | G | 7 | 8 | 1.1 | G |
| L | 12 | 0.008 | 5 | 6 | 1.2 | G | 5 | 6 | 1.2 | G |
| M | 13 | 0.008 | 12 | 15 | 1.3 | G | 11 | 15 | 1.4 | G |
| N | 14 | 0.003 | 6 | 8 | 1.3 | G | 6 | 8 | 1.3 | G |
| O | 15 | 0.011 | 2 | 3 | 1.5 | B | 2 | 3 | 1.5 | B |
| P | 16 | 0.005 | 4 | 5 | 1.3 | G | 4 | 5 | 1.3 | G |
| Q | 17 | 0.006 | 7 | 9 | 1.3 | G | 7 | 9 | 1.3 | G |
| R | 18 | 0.007 | 16 | 18 | 1.1 | G | 15 | 18 | 1.2 | G |
| S | 19 | 0.008 | 10 | 12 | 1.2 | G | 10 | 12 | 1.2 | G |
| T | 20 | 0.004 | 6 | 7 | 1.2 | G | 6 | 7 | 1.2 | G |
| U | 21 | 0.008 | 8 | 10 | 1.3 | G | 7 | 9 | 1.3 | G |
| W | 22 | 0.006 | 16 | 20 | 1.3 | G | 15 | 20 | 1.3 | G |
| X | 23 | 0.007 | 23 | 26 | 1.1 | G | 22 | 25 | 1.1 | G |
| Y | 24 | 0.005 | 22 | 28 | 1.3 | G | 20 | 28 | 1.4 | G |
| Z | 25 | 0.012 | 20 | 31 | 1.6 | B | 22 | 32 | 1.5 | B |

TABLE 8

| Steel type reference symbol | Test reference symbol | Cold rolled steel sheet for hot stamping: Left side of expression (b) | Determination | Hot Stamped steel: Left side of expression (b) | Determination | Cold rolled steel sheet for hot stamping: Left side of expression (c) | Determination | Hot Stamped steel: Left side of expression (c) | Determination | Cold rolled steel sheet for hot stamping Area: fraction of MnS of 0.1 μm or more (%) |
|---|---|---|---|---|---|---|---|---|---|---|
| AA | 26 | 1.18 | B | 1.18 | B | 22 | B | 23 | B | 0.009 |
| AB | 27 | 1.15 | B | 1.15 | B | 21 | B | 19 | G | 0.008 |
| AC | 28 | 1.2 | B | 1.19 | B | 24 | B | 22 | B | 0.006 |
| AD | 29 | 1.14 | B | 1.13 | B | 22 | B | 25 | B | 0.007 |
| AE | 30 | 1.11 | B | 1.12 | B | 20 | B | 18 | G | 0.009 |
| AF | 31 | 1.12 | B | 1.14 | B | 22 | B | 21 | B | 0.002 |
| AG | 32 | 1.13 | B | 1.13 | B | 23 | B | 22 | B | 0.003 |
| AH | 33 | 1.16 | B | 1.16 | B | 21 | B | 21 | B | 0.004 |
| AI | 34 | 1.23 | B | 1.18 | B | 25 | B | 25 | B | 0.006 |
| AJ | 35 | 1.21 | B | 1.21 | B | 24 | B | 24 | B | 0.007 |
| AK | 36 | 1.16 | B | 1.15 | B | 21 | B | 21 | B | 0.006 |
| AL | 37 | 1.35 | B | 1.37 | B | 31 | B | 30 | B | 0.006 |
| AM | 38 | 1.32 | B | 1.32 | B | 30 | B | 31 | B | 0.006 |
| AN | 39 | 1.23 | B | 1.25 | B | 25 | B | 28 | B | 0.008 |
| AO | 40 | 1.34 | B | 1.33 | B | 30 | B | 32 | B | 0.004 |
| AP | 41 | 1.05 | G | 1.04 | G | 12 | G | 11 | G | 0.002 |
| AQ | 42 | 1.04 | G | 1.05 | G | 18 | G | 15 | G | 0.003 |
| AR | 43 | 1.13 | B | 1.14 | B | 26 | B | 26 | B | 0.002 |
| AS | 45 | 1.11 | B | 1.15 | B | 26 | B | 25 | B | 0.007 |
| AT | 46 | 1.25 | B | 1.27 | B | 26 | B | 27 | B | 0.004 |
| AU | 47 | 1.05 | G | 1.06 | G | 17 | G | 16 | G | 0.003 |
| AV | 48 | 1.12 | B | 1.13 | B | 21 | B | 23 | B | 0.005 |

| Steel type reference symbol | Test reference symbol | Hot Stamped steel Area: fraction of MnS of 0.1 μm or more (%) | Cold rolled steel sheet for hot stamping: n1 | n2 | Left side of expression (d) | Determination | Hot Stamped steel: n1 | n2 | Left side of expression (d) | Determination |
|---|---|---|---|---|---|---|---|---|---|---|
| AA | 26 | 0.009 | 13 | 15 | 1.2 | G | 12 | 15 | 1.3 | G |
| AB | 27 | 0.008 | 7 | 10 | 1.4 | G | 8 | 11 | 1.4 | G |
| AC | 28 | 0.006 | 14 | 19 | 1.4 | G | 13 | 18 | 1.4 | G |
| AD | 29 | 0.007 | 6 | 7 | 1.2 | G | 6 | 7 | 1.2 | G |
| AE | 30 | 0.009 | 12 | 15 | 1.3 | G | 12 | 15 | 1.3 | G |
| AF | 31 | 0.002 | 18 | 23 | 1.3 | G | 17 | 22 | 1.3 | G |
| AG | 32 | 0.003 | 6 | 7 | 1.2 | G | 6 | 7 | 1.2 | G |
| AH | 33 | 0.004 | 4 | 5 | 1.3 | G | 4 | 5 | 1.3 | G |
| AI | 34 | 0.006 | 12 | 14 | 1.2 | G | 12 | 13 | 1.1 | G |
| AJ | 35 | 0.007 | 15 | 17 | 1.1 | G | 15 | 17 | 1.1 | G |
| AK | 36 | 0.007 | 11 | 12 | 1.1 | G | 11 | 12 | 1.1 | G |
| AL | 37 | 0.006 | 12 | 17 | 1.4 | G | 12 | 17 | 1.4 | G |
| AM | 38 | 0.006 | 15 | 21 | 1.4 | G | 16 | 21 | 1.3 | G |
| AN | 39 | 0.008 | 10 | 12 | 1.2 | G | 10 | 11 | 1.1 | G |
| AO | 40 | 0.004 | 8 | 11 | 1.4 | G | 8 | 11 | 1.4 | G |
| AP | 41 | 0.006 | 6 | 8 | 1.3 | G | 6 | 8 | 1.3 | G |
| AQ | 42 | 0.003 | 12 | 15 | 1.3 | G | 12 | 15 | 1.3 | G |
| AR | 43 | 0.002 | 23 | 26 | 1.1 | G | 23 | 25 | 1.1 | G |
| AS | 45 | 0.007 | 16 | 18 | 1.1 | G | 15 | 18 | 1.2 | G |
| AT | 46 | 0.005 | 17 | 19 | 1.1 | G | 16 | 17 | 1.1 | G |
| AU | 47 | 0.003 | 18 | 20 | 1.1 | G | 16 | 18 | 1.1 | G |
| AV | 48 | 0.005 | 18 | 19 | 1.1 | G | 17 | 18 | 1.1 | G |

It is found from Tables 1 to 8 that, when the conditions of the present invention are satisfied, it is possible to obtain the hot stamped steel for which the high-strength cold rolled steel sheet satisfying TS×λ≥50000 MPa·% is used.

INDUSTRIAL APPLICABILITY

According to the present invention, since an appropriate relationship is established among the amount of the C, the amount of the Mn and the amount of the Si, and an appropriate hardness measured with a nanoindenter is provided to the martensite, it is possible to provide the hot stamped steel which ensures the strength of 1.5 GPa or more, and has a more favorable hole expansibility.

BRIEF DESCRIPTION OF THE REFERENCE SYMBOLS

S1: MELTING PROCESS
S2: CASTING PROCESS
S3: HEATING PROCESS
S4: HOT-ROLLING PROCESS

S5: COILING PROCESS
S6: PICKLING PROCESS
S7: COLD-ROLLING PROCESS
S8: ANNEALING PROCESS
S9: TEMPER-ROLLING PROCESS
S10: HOT STAMPING PROCESS
S11: GALVANIZING PROCESS
S12: ALLOYING PROCESS
S13: ALUMINIZING PROCESS
S14: ELECTROGALVANIZING PROCESS

The invention claimed is:

1. A hot stamped steel comprising, by mass %:
C: more than 0.150% to 0.300%;
Si: 0.010% to 1.000%;
Mn: 1.50% to 2.70%;
P: 0.001% to 0.060%;
S: 0.001% to 0.010%;
N: 0.0005% to 0.0100%; and
Al: 0.010% to 0.050%; and
optionally one or more of
B: 0.0005% to 0.0020%;
Mo: 0.01% to 0.50%;
Cr: 0.01% to 0.50%;
V: 0.001% to 0.100%;
Ti: 0.001% to 0.100%;
Nb: 0.001% to 0.050%;
Ni: 0.01% to 1.00%;
Cu: 0.01% to 1.00%;
Ca: 0.0005% to 0.0050%; and
REM: 0.0005% to 0.0050%; and
a balance including Fe and unavoidable impurities,
wherein, when [C] represents an amount of C by mass %, [Si] represents an amount of Si by mass %, and [Mn] represents an amount of Mn by mass %, a following expression a is satisfied,
a metallographic structure includes 80% or more of a martensite in an area fraction, and optionally, further includes one or more of 10% or less of a pearlite in an area fraction, 5% or less of a retained austenite in a volume ratio, 20% or less of a ferrite in an area fraction, and less than 20% of a bainite in an area fraction,
TS×λ which is a product of TS that is a tensile strength and λ that is a hole expansion ratio is 50000 MPa·% or more, and
a hardness of the martensite measured with a nanoindenter satisfies a following expression b and a following expression c, $$(5\times[Si]+[Mn])/[C]>10 \quad (a)$$

$$1.005\leq H2/H1<1.10 \quad (b)$$

$$\sigma HM<20 \quad (c)$$

here, the H1 represents an average hardness of the martensite in a surface portion, the H2 represents the average hardness of the martensite in a center part of a sheet thickness that is an area having a width of ±100 μm in a thickness direction from a center of the sheet thickness, and the σHM represents a variance of the hardness of the martensite existing in the central part of the sheet thickness.

2. The hot stamped steel according to claim 1, wherein an area fraction of a MnS existing in the metallographic structure and having an equivalent circle diameter of 0.1 μm to 10 μm is 0.01% or less, and a following expression d is satisfied, $$n2/n1<1.5 \quad (d)$$

here, the n1 represents an average number density per 10000 $\mu m^2$ of the MnS in a ¼ part of the sheet thickness, and the n2 represents an average number density per 10000 $\mu m^2$ of the MnS in the central part of the sheet thickness.

3. The hot stamped steel according to claim 1 or 2, wherein a hot dip galvanized layer is formed on a surface thereof.

4. The hot stamped steel according to claim 3, wherein the hot dip galvanized layer includes a galvannealed layer.

5. The hot stamped steel according to claim 1 or 2, wherein an electrogalvanized layer is formed on a surface thereof.

6. The hot stamped steel according to claim 1 or 2, wherein an aluminized layer is formed on a surface thereof.

7. A method for producing a hot stamped steel comprising:
casting a molten steel having a chemical composition according to claim 1 and obtain a steel;
heating the steel;
hot-rolling the steel with a hot-rolling facility having a plurality of stands;
coiling the steel after the hot-rolling;
pickling the steel after the coiling;
cold-rolling the steel after the pickling with a cold rolling mill having a plurality of stands under a condition satisfying a following expression e;
annealing in which the steel is heated under 700° C. to 850° C. and cooled after the cold-rolling;
temper-rolling the steel after the annealing; and
hot stamping in which the steel is heated to a temperature range of 750° C. or more at a temperature-increase rate of 5° C./second or more, formed within the temperature range, and cooled to 20° C. to 300° C. at a cooling rate of 10° C./second or more after the temper-rolling, $$1.5\times r1/r+1.2\times r2/r+r3/r>1 \quad (e)$$

wherein ri (i=1, 2 or 3) represents an individual target cold-rolling reduction in unit % at an $i^{th}$ stand (i=1, 2 or 3) based on an uppermost stand among the plurality of the stands in the cold-rolling, and r represents a total cold-rolling reduction in unit % in the cold-rolling, and
wherein an area fraction of a pearlite of the steel before the cold-rolling is 15% or more and the area fraction of the pearlite of the steel after the temper-rolling is 10% or less.

8. The method for producing a hot stamped steel according to claim 7,
wherein, when CT in unit ° C. represents a coiling temperature in the coiling;
[C] represents an amount of C by mass %, [Mn] represents an amount of Mn by mass %,
[Cr] represents an amount of Cr by mass %, and [Mo] represents an amount of Mo by mass % in the steel;
a following expression f is satisfied;

$$560-474\times[C]-90\times[Mn]-20\times[Cr]-20\times[Mo]<CT<830-270\times[C]-90\times[Mn]-70\times[Cr]-80\times[Mo] \quad (f).$$

9. The method for producing a hot stamped steel according to claim 7 or 8,
wherein, when T in unit ° C. represents a heating temperature in the heating, t in unit minutes represents an in-furnace time; and
[Mn] represents an amount of Mn by mass %, and [S] represents an amount of S by mass % in the steel,
a following expression g is satisfied, $$T\times\ln(t)/(1.7\times[Mn]+[S])>1500 \quad (g).$$

10. The method for producing a hot stamped steel according to claim 7 or 8, further comprising:

galvanizing the steel between the annealing and the temper-rolling.

11. The method for producing a hot stamped steel according to claim 10, further comprising:

alloying the steel between the hot dip galvanizing and the temper-rolling.

12. The method for producing a hot stamped steel according to claim 7 or 8, further comprising:

electrogalvanizing the steel between the temper-rolling and the hot stamping.

13. The method for producing a hot stamped steel according to claim 7 or 8, further comprising:

aluminizing the steel between the annealing and the temper-rolling.

* * * * *